US011834295B2

(12) United States Patent
Osawa et al.

(10) Patent No.: US 11,834,295 B2
(45) Date of Patent: Dec. 5, 2023

(54) ELEVATOR OPERATION MANAGING DEVICE AND ELEVATOR OPERATION MANAGING METHOD THAT ALLOCATES A USER TO A CAR BASED ON BOARDING AND DESTINATION FLOORS

(71) Applicant: Mitsubishi Electric Corporation, Chiyoda-ku (JP)

(72) Inventors: Nanaho Osawa, Tokyo (JP); Satoko Sakajo, Tokyo (JP); Naohiko Suzuki, Tokyo (JP); Sakurako Tokura, Tokyo (JP); Eunjin Choi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1417 days.

(21) Appl. No.: 16/092,911

(22) PCT Filed: Mar. 8, 2017

(86) PCT No.: PCT/JP2017/009260
§ 371 (c)(1),
(2) Date: Oct. 11, 2018

(87) PCT Pub. No.: WO2017/199548
PCT Pub. Date: Nov. 23, 2017

(65) Prior Publication Data

US 2019/0144238 A1 May 16, 2019

(30) Foreign Application Priority Data

May 18, 2016 (JP) ..... 2016-099306

(51) Int. Cl.
*B66B 1/34* (2006.01)
*B66B 1/24* (2006.01)

(52) U.S. Cl.
CPC ..... *B66B 1/2458* (2013.01); *B66B 1/3415* (2013.01); *B66B 1/3476* (2013.01);
(Continued)

(58) Field of Classification Search
CPC ... B66B 1/3476; B66B 1/3484; B66B 46/467; B66B 5/00–0012; B66B 2201/20;
(Continued)

(56) References Cited

U.S. PATENT DOCUMENTS 4,458,787 A * 7/1984 Uetani ..... B66B 1/2458 187/387
5,250,766 A * 10/1993 Hikita ..... B66B 1/2408 187/247

(Continued)

FOREIGN PATENT DOCUMENTS

JP 2011-57322 A 3/2011
JP 2014-189338 A 10/2014

(Continued)

OTHER PUBLICATIONS

International Search Report dated Jun. 13, 2017 in PCT/JP2017/009260 filed Mar. 8, 2017.

*Primary Examiner* — Christopher Uhlir
(74) *Attorney, Agent, or Firm* — XSENSUS LLP

(57) ABSTRACT

An elevator operation managing device capable of reducing a switching of passengers at a time of getting on and getting out of a car. The elevator operation managing device includes an in-car position acquisition unit and a car allocation acquisition unit. The in-car position acquisition unit obtains an in-car position of a user based on layout information and a congestion degree obtained in a congestion degree acquisition unit. The car allocation acquisition unit performs a car allocation to allocate the user to the car based on a received boarding floor and destination floor and the (Continued)

in-car position obtained in the in-car position acquisition unit.

14 Claims, 28 Drawing Sheets

(52) U.S. Cl.
CPC ... *B66B 2201/102* (2013.01); *B66B 2201/103* (2013.01); *B66B 2201/20* (2013.01); *B66B 2201/211* (2013.01); *B66B 2201/222* (2013.01)

(58) Field of Classification Search
CPC ..... B66B 2201/21; B66B 2201/215; B66B 2201/222; B66B 2201/235
See application file for complete search history.

(56) References Cited

U.S. PATENT DOCUMENTS

| | | | | |
|---|---|---|---|---|
| 5,467,844 | A * | 11/1995 | Powell | B66B 1/18 187/383 |
| 6,357,554 | B1 * | 3/2002 | Valk | B66B 1/3484 187/292 |
| 8,020,672 | B2 * | 9/2011 | Lin | B66B 1/468 187/316 |
| 9,988,238 | B2 * | 6/2018 | Simcik | B66B 1/468 |
| 2015/0068848 | A1 * | 3/2015 | Stanley | B66B 1/2408 187/384 |
| 2017/0291792 | A1 * | 10/2017 | Scoville | B66B 1/3407 |

FOREIGN PATENT DOCUMENTS

| | | | |
|---|---|---|---|
| JP | 2015-218015 | A | 12/2015 |
| JP | 2016-159993 | A | 9/2016 |

* cited by examiner

F I G . 3

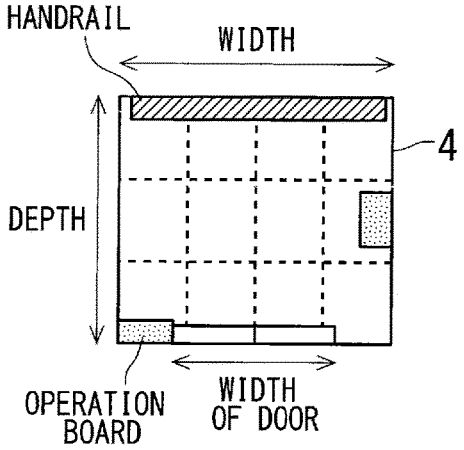

PHYSICAL SIZE
- WIDTH
- DEPTH
- FLOOR SPACE

INFORMATION REGARDING DOOR
- SINGLE SWING/DOUBLE SWING
- WIDTH OF DOOR
- PRESENCE OR ABSENCE OF WINDOW

FACILITY INFORMATION
- POSITION OF OPERATION BOARD
- SEE-THROUGH OR NOT
- POSITION OF MONITORING CAMERA
- POSITION OF CHAIR
- POSITION OF DISPLAY
- POSITION OF HANDRAIL

POSITION OF CAR IN RELATION TO BOARDING AREA
- DISTANCE FROM DESTINATION REGISTRATION DEVICE
- DISTANCE FROM ENTRANCE

INFORMATION REGARDING PASSENGER
- MAXIMUM LOADING WEIGHT
- MAXIMUM NUMBER OF PASSENGERS
- NUMBER OF PASSENGERS WHO CAN STAND BY WALL

FIG. 4

| CAR NUMBER /NAME | CURRENT POSITION | MOVING DIRECTION | ESTIMATED FLOOR |
|---|---|---|---|
| A | FIRST FLOOR | UP | FIFTH FLOOR, NINTH FLOOR, ··· |
| B | FIRST TO SECOND FLOOR | UP | FOURTH FLOOR, TENTH FLOOR, ··· |
| C | THIRD FLOOR | DOWN | FIRST FLOOR, SIXTH FLOOR, ··· |
| ··· | ··· | ··· | ··· |

FIG. 5

| CAR NUMBER /NAME | CURRENT POSITION | MOVING DIRECTION | ESTIMATED FLOOR AND NUMBER OF PASSENGERS | | |
|---|---|---|---|---|---|
| A | FIRST FLOOR | UP | FIFTH FLOOR: TEN PASSENGERS GET OUT OF CAR | NINTH FLOOR: THREE PASSENGERS GET OUT OF CAR | ... |
| B | FIRST TO SECOND FLOOR | UP | FOURTH FLOOR: TWO PASSENGERS GET OUT OF CAR, FOUR PASSENGERS GET ON CAR | TENTH FLOOR: TWENTY PASSENGERS GET OUT OF CAR | ... |
| C | THIRD FLOOR | DOWN | FIRST FLOOR: FIVE PASSENGERS GET OUT OF CAR, TWENTY PASSENGERS GET ON CAR | SIX FLOOR: TEN PASSENGERS GET OUT OF CAR | ... |
| ... | ... | ... | ... | ... | ... |

F I G . 6

| CAR NUMBER /NAME | CURRENT POSITION | MOVING DIRECTION | ESTIMATED FLOOR | USER (IN ORDER OF REGISTRATION) | | |
|---|---|---|---|---|---|---|
| A | FIRST FLOOR | UP | FIFTH FLOOR, NINTH FLOOR, ··· | USER X: GET ON AT FIRST FLOOR →GET OUT AT FIFTH FLOOR | USER Y: GET ON AT FIRST FLOOR →GET OUT AT NINTH FLOOR | ··· |
| B | FIRST TO SECOND FLOOR | UP | FOURTH FLOOR, TENTH FLOOR, ··· | USER x: GET ON AT FIRST FLOOR →GET OUT AT FOURTH FLOOR | USER y: GET ON AT FIRST FLOOR →GET OUT AT TENTH FLOOR | ··· |
| C | THIRD FLOOR | DOWN | FIRST FLOOR, SIXTH FLOOR, ··· | USER xx: GET ON AT THIRD FLOOR →GET OUT AT FIRST FLOOR | USER yy: GET ON AT THIRD FLOOR →GET OUT AT SIXTH FLOOR | ··· |
| ··· | ··· | ··· | ··· | ··· | ··· | ··· |

F I G . 7

| CAR NUMBER /NAME | CURRENT POSITION | MOVING DIRECTION | ESTIMATED FLOOR | CONGESTION DEGREE | | |
|---|---|---|---|---|---|---|
| A | FIRST FLOOR | UP | FIFTH FLOOR, NINTH FLOOR, ··· | FIRST FLOOR: TEN PASSENGERS | SECOND FLOOR: TWENTY PASSENGERS | ··· |
| B | FIRST TO SECOND FLOOR | UP | FOURTH FLOOR, TENTH FLOOR, ··· | FIRST TO THIRD FLOOR: LARGE | FOURTH FLOOR: MIDDLE | ··· |
| C | THIRD FLOOR | DOWN | FIRST FLOOR, SIXTH FLOOR, ··· | THIRD TO FIRST FLOOR: 0% | FIRST TO THIRD FLOOR: 20% | ··· |
| ··· | ··· | ··· | ··· | ··· | ··· | ··· |

CAR D
- NUMBER OF USERS WHO CAN WAIT: X USERS
- DISTANCE FROM DESTINATION REGISTRATION DEVICE: Y SECONDS
- ADJACENT TO WAITING POSITION OF CAR A
- USE WAITING POSITIONS OF CARS B, E, C AND F AS PATHWAY

- NUMBER OF PASSENGERS: X
- CONGESTION DEGREE: Y%
- CAR ALLOCATION: FOURTH FLOOR, FIFTH FLOOR, SIXTH FLOOR, SIXTH FLOOR, SIXTH FLOOR, SIXTH FLOOR, . . .
- NUMBER OF PASSENGERS GETTING ON CAR AT FOURTH FLOOR: ZERO

ELEVATOR OPERATION MANAGING DEVICE AND ELEVATOR OPERATION MANAGING METHOD THAT ALLOCATES A USER TO A CAR BASED ON BOARDING AND DESTINATION FLOORS

TECHNICAL FIELD

The present invention relates to an elevator operation managing device and an elevator operation management method for managing an operation of an elevator.

BACKGROUND ART

Proposed in a conventional elevator operation managing device is an elevator operation managing technique of distributing elevators which a passenger gets on, that is to say, elevator cars to each destination floor so that a total number of floors at which elevators stop is reduced to increase operation efficiency.

In such an elevator operation management, if the elevator car is crowded with a large number of passengers, the passenger located away from a door may have trouble getting out of the elevator due to the other passengers in the way of the passenger when the passenger gets out of the elevator. In this case, an opening and closing time of the door increases, thereby reducing operation efficiency. Comparatively increased is a psychological burden of the passengers that the passengers being to get out of the elevator expresses their intention to get out of the elevator, and in contrast, the passengers being to remain in the elevator move aside with consideration for the passengers getting out of the elevator, for example. Proposed accordingly is that an in-car position of a passenger and a waiting position of a user in a boarding area are instructed to deal with a switching of the passengers in the car at a time of getting on and getting out of the car. Such a technique is proposed in Patent Documents 1 to 3, for example.

PRIOR ART DOCUMENTS

Patent Documents

Patent Document 1: Japanese Patent Application Laid-Open No. 2011-057322

Patent Document 2: Japanese Patent Application Laid-Open No. 2014-189338

Patent Document 3: Japanese Patent Application Laid-Open No. 2015-218015

SUMMARY

Problem to be Solved by the Invention

In the elevator operation managing device in each of Patent Documents 1 to 3, the in-car position and the waiting position in the boarding area are only instructed in a reflection of a result of a car allocation performed by the elevator operation managing device, so that the car allocation in consideration of the in-car position is not performed. Thus, if the passengers do not move as instructed in the crowded car, for example, there still arises a problem that the switching of the passengers in the car still occurs at the time of getting on and getting out of the car.

The present invention therefore has been made to solve the above problems, and it is an object of the present invention to provide a technique capable of reducing a switching of passengers at a time of getting on and getting out of a car.

Means to Solve the Problem

An elevator operation managing device according to the present invention is an elevator operation managing device managing an operation of a car of an elevator, and includes: a receiving unit receiving a boarding floor and a destination floor of a user of the elevator before the user gets on the car, a congestion degree acquisition unit obtaining a congestion degree in the car when the user gets on the car based the boarding floor and the destination floor received by the receiving unit; an in-car position acquisition unit obtaining the in-car position of the user when the user gets on the car based on the congestion degree obtained in the congestion degree acquisition unit; and a car allocation acquisition unit performing a car allocation for allocating the user to the car based on the boarding floor and the destination floor received by the receiving unit and the in-car position obtained in the in-car position acquisition unit.

Effects of the Invention

According to the present invention, the user is allocated to the car based on the boarding floor and destination floor received by the receiving unit and the in-car position obtained in the in-car position acquisition unit. Accordingly, a switching of passengers can be reduced at a time of getting on and getting out of the car.

These and other objects, features, aspects and advantages of the present invention will become more apparent from the following detailed description of the present invention when taken in conjunction with the accompanying drawings.

BRIEF DESCRIPTION OF DRAWINGS

FIG. 3 A drawing illustrating an example of layout information.

FIG. 4 A drawing illustrating an example of car allocation information.

FIG. 5 A drawing illustrating an example of the car allocation information.

FIG. 6 A drawing illustrating an example of the car allocation information.

FIG. 7 A drawing illustrating an example of a congestion degree.

FIG. 18 A block diagram illustrating a configuration of an elevator operation managing device according to an embodiment 2.

DESCRIPTION OF EMBODIMENT(S)

Embodiment 1

<Description of Whole Configuration>

Figure 1:
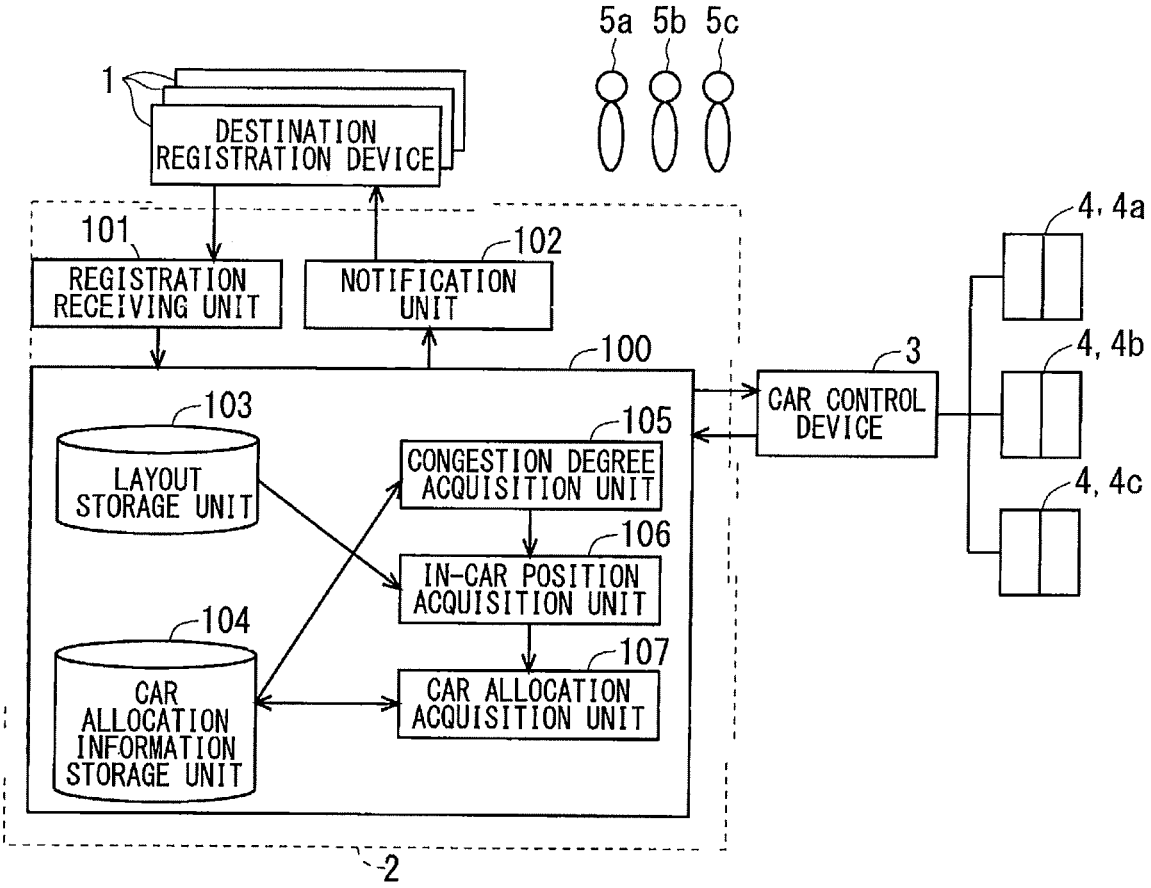
FIG. 1 A block diagram illustrating a configuration of an elevator operation managing device according to an embodiment 1.

FIG. 1 is a block diagram illustrating a configuration of an elevator operation managing device according to the embodiment 1 of the present invention. One or more user including users 5*a* to 5*c*, for example, register, using a destination registration device 1, a boarding floor at which the users are to get on an elevator and a destination floor to which the users intend to go using the elevator. Upon the execution of the registration, the elevator operation managing device 2 performs a car allocation for allocating the users to a car 4 of the elevator in accordance with the registered boarding floor and the destination floor, and the destination registration device 1 notifies the users of a result of the car allocation notified by the elevator operation managing device 2. The elevator operation managing device 2 sends an instruction to a car control device 3 based on a result of the car allocation, and the car control device 3 controls and operates the car 4 including cars 4*a* to 4*c*, for example, based on the instruction from the elevator operation managing device 2. As described above, the elevator operation managing device 2 manages the operation of the car 4 of the elevator. Although there are three cars 4 in the description of the present embodiment 1, a plurality of cars other than three cars may also be applicable, or one car 4 may also be applicable as a modification example described hereinafter. The user who gets on the car may be referred to as the "passenger" in the description below in some cases.

The elevator operation managing device 2 in FIG. 1 includes a registration receiving unit 101 receiving the boarding floor and the destination floor of the user of the elevator from the destination registration device 1 before the user gets on the car 4, an operation management acquisition unit 100 allocating the car 4 based on the boarding floor and the destination floor received by the registration receiving unit 101, and a notification unit 102 which can notify the user of the result of the car allocation performed by the operation management acquisition unit 100 via the destination registration device 1. A receiving unit according to the present invention can be referred to as the registration receiving unit 101 in FIG. 1, and a first notification unit according to the present invention can be referred to as the notification unit 102 in FIG. 1.

The operation management acquisition unit 100 has a layout storage unit 103, a car allocation information storage unit 104, a congestion degree acquisition unit 105, an in-car position acquisition unit 106, and a car allocation acquisition unit 107.

The layout storage unit 103 stores layout information including physical information regarding the car 4. The congestion degree acquisition unit 105 obtains a congestion degree in the car 4 when the user gets on the car 4 based on the boarding floor and the destination floor received by the registration receiving unit 101. The in-car position acquisition unit 106 obtains the in-car position of the user in the car in accordance with a predetermined behavior of getting on the car when the user gets on the car 4 based on the layout information regarding the car 4 stored in the layout storage unit 103 and the congestion degree obtained in the congestion degree acquisition unit 105.

The car allocation acquisition unit 107 performs a car allocation to allocate the user to the car 4 based on the boarding floor and the destination floor received by the registration receiving unit 101 and the in-car position obtained in the in-car position acquisition unit 106. The result of the car allocation performed by the car allocation acquisition unit 107 is stored in the car allocation information storage unit 104 and provided by the notification unit 102. Although the congestion degree, for example, is obtained by a calculation in the description described below, the configuration thereof is not limited thereto.

A receiving device and an input device, for example, are applied to the registration receiving unit 101, and a transmission device and an output device, for example, are applied to the notification unit 102. A memory and a storage device, for example, are applied to the layout storage unit 103 and the car allocation information storage unit 104.

The congestion degree acquisition unit 105, the in-car position acquisition unit 106, and the car allocation acquisition unit 107 are achieved as functions of a CPU, which is not shown in the drawing, executing a program such as an operating system (OS) stored in a memory. However, the configuration is not limited to the above example, but at least one of the congestion degree acquisition unit 105, the in-car position acquisition unit 106, and the car allocation acquisition unit 107 may be achieved by dedicated hardware. A term of a "processing circuit" may be used as a concept of combining the congestion degree acquisition unit 105, the in-car position acquisition unit 106, and the car allocation acquisition unit 107 of software and the congestion degree acquisition unit 105, the in-car position acquisition unit 106, and the car allocation acquisition unit 107 of hardware.

<Description of Each Constituent Element>

Each constituent element is described in detail next. Before the description of the constituent element of the elevator operation managing device 2, the destination registration device 1 connected to the elevator operation managing device 2 is described first.

<Description of Destination Registration Device 1>

Figure 2:
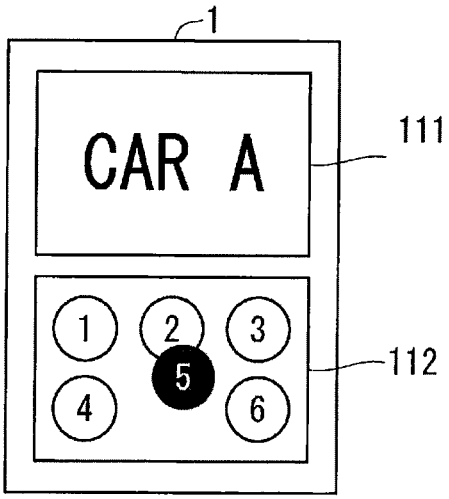
FIG. 2 A drawing illustrating an example of a destination registration device.

FIG. 2 is a drawing illustrating an example of the destination registration device 1. The destination registration device 1 may be a dedicated terminal disposed in a boarding area, a mobile terminal such as a smartphone, or an interface for displaying a screen of a web service which can be viewed from a browser on a personal computer (PC).

The destination registration device 1 includes a notification unit 111 notifying the user of the result of the car allocation performed by the car allocation acquisition unit 107 provided by the elevator operation managing device 2 and a registration unit 112 registering the boarding floor and the destination floor of the user. One terminal made up of the notification unit 111 and the registration unit 112 integrated with each other may be applied to the notification unit 111 and the registration unit 112, or a plurality of terminals in which the notification unit 111 and the registration unit 112 are separated may also be applied.

The notification unit 111 previously provides a notification of information of the car allocated to the user, that is to say, information of the car 4 on which the user is to get or a notification that the car is not allocated to the user. In the example in FIG. 2, the notification unit 111 provides the notification of a number or name of the car, however, the configuration is not limited thereto, but the notification unit 111 may provide the notification of a color of the car or a map of a boarding area indicating a position of the car or a position of the user, for example. In addition to the information described above, the notification unit 111 may provide a notification of, for example, an estimated arrival time or a congestion degree of the car, an expected in-car position of the user in the car, an order of getting on the car, an estimated floor at which the car stops, a total number of fellow users, an attribution of the user such as male and female, and a combination of a getting-out floor at which the user gets out of the car and a total number of users. In the example in FIG. 2, the notification unit 111 provides a notification of the result of the car allocation by displaying visual information, however, the notification unit 111 may provide a notification using sound information, a vibration, or brightness of a light, for example.

The registration unit 112 receives the boarding floor and the destination floor of the user before the user gets on the car. If the destination registration device 1 is not a dedicated terminal disposed in a boarding area, a boarding floor corresponding to the boarding area is previously registered in the registration unit 112. FIG. 2 illustrates an example of the destination registration device 1 disposed in the boarding area, and specifically illustrates a system of previously displaying buttons of candidate destination floors and selecting the destination floor from the buttons. However, the configuration of the registration unit 112 is not limited thereto, but the boarding floor and the destination floor may be registered by inputting a numeral value with a ten key, inputting a handwritten character, performing a selection by a scrolling function, or using an integrated circuit (IC) card in which the boarding floor and the destination floor are previously registered. Not only the boarding floor and the destination floor but also a choice of a car attribution such as a fast car, a choice of a car close to the user, a choice of an empty car, a choice of an in-car position such as a position near a wall or a central position of the car, or a choice of an order in getting on the car that the user intends to get on the car early, for example, may be registered. Furthermore, attribute information of the user such as male or female, a baby buggy, a wheelchair, and a favorite in-car position may also be registered.

<Description of Registration Receiving Unit 101>

The registration receiving unit 101 of the elevator operation managing device 2 receives the information registered in the registration unit 112 of the destination registration device 1 before the user gets on the car. The information received by the registration receiving unit 101 is similar to the information registered in the registration unit 112. In the present embodiment 1, the registration receiving unit 101 indirectly receives the boarding floor and the destination floor via the destination registration device 1, however, the registration receiving unit 101 itself may receive the boarding floor and the destination floor, for example, from the user.

<Description of Notification Unit 102>

The notification unit 102 of the elevator operation managing device 2 notifies the destination registration device 1 of the information provided by the notification unit 111 of the destination registration device 1. The information provided by the notification unit 102 is similar to the information provided by the notification unit 111. In the present embodiment 1, the notification unit 102 indirectly provides the notification of the result of the car allocation performed by the car allocation acquisition unit 107 via the destination registration device 1, however, the notification unit 102 itself may notify the user of the result of the car allocation.

<Description of Layout Storage Unit 103>

FIG. 3 is a drawing illustrating an example of layout information of the car stored in the layout storage unit 103. The layout information stored in the layout storage unit 103 includes information regarding a physical size of the car 4, information regarding a door, facility information, information regarding a position of the car in relation to the boarding area, and information regarding the passenger. The information regarding the physical size of the car includes a width, a depth, and a floor space, for example. The information regarding the door includes a single swing/double swing, a width of a door including a range of the door, presence or absence of a window, for example. The facility information includes a position of an operation board, a see-through configuration or not, a position of a monitoring camera, a position of a chair, a position of a display, and a position of a handrail, for example. The information regarding the position of the car in relation to the boarding area includes a distance from the destination registration device 1 disposed in the boarding area and a distance from an entrance, for example. The information regarding the passenger includes a maximum loading weight, a maximum number of passengers, and a total number of passengers who can stand by a wall, for example. A position away from the door in the car is also referred to as a "back of the car" in some cases in the description hereinafter.

The layout information stored in the layout storage unit 103 may be input by hand or may be acquired from a facility management database, for example. The layout information stored in the layout storage unit 103 is not limited to the example in FIG. 3.

<Description of Car Allocation Information Storage Unit 104>

FIG. 4 to FIG. 6 are drawings each illustrating an example of the car allocation information indicating the result of the car allocation obtained in the car allocation acquisition unit 107.

An example in FIG. 4 shows, as the car allocation information, a car number/name, a current position of the car, a current moving direction of the car, and an estimated floor at which the car will stop. An example in FIG. 5 shows, as the car allocation information, a car number/name, a current position of the car, a current moving direction of the car, an estimated floor described above, and a total number of passengers who get on and get out of the car. An example in FIG. 6 shows, as the car allocation information, a car number/name, a current position of the car, a current moving direction of the car, an estimated floor described above, and a boarding floor and a destination floor for each user in an order of registration. The car allocation information is not limited to the examples in FIG. 4 to FIG. 6.

In the present embodiment 1, a history of the result of the car allocation obtained in the car allocation acquisition unit 107 is stored in the car allocation information storage unit 104. The result of the car allocation stored in the car allocation information storage unit 104 is referred to as the "past the car allocation information" hereinafter.

The past car allocation information includes past car allocation information which has not been used but will be used in the near future and past car allocation information which has actually been used in the past. Herein, the past car allocation information includes not only the result of the car allocation performed by the car allocation acquisition unit 107 but also information regarding the number of passengers which is the number of passengers who get on the car controlled based on the result of the car allocation. The information regarding the number of passengers may be the number of passengers in the car, the number of passengers who get on and get out of the car at each floor, and a loading weight in the car measured in the car, for example.

Every time the car allocation is performed by the car allocation acquisition unit 107, the car allocation to which a time stamp is allocated is stored in the car allocation information storage unit 104 to store past car allocation information. For example, at a timing of when the car allocation is performed by the car allocation acquisition unit 107 and the result of the car allocation is stored in the car allocation information storage unit 104, the result of the car allocation and the time stamp are stored in the car allocation information storage unit 104. Not only the time stamp of the time and the date at the time of recording but also a day of week, a season, and weather at the time of recording may be associated and stored, for example.

<Description of Congestion Degree Acquisition Unit 105>

The congestion degree acquisition unit 105 obtains a congestion degree in the car when the user gets on the car based on the boarding floor and the destination floor received by the registration receiving unit 101 and the past car allocation information. FIG. 7 is a drawing illustrating an example of the congestion degree obtained in the congestion degree acquisition unit 105. The congestion degree may be expressed by the number of passengers for each floor such as the car A in FIG. 7, expressed in a plurality of levels of large, middle, small, and empty for each floor or each of the plurality of floors such as the car B in FIG. 7, or expressed by a car occupancy obtained from the loading weight for each floor or each of the plurality of floors such as the car C in FIG. 7.

The congestion degree can be obtained by calculating how many passengers will get on the car at each floor from a combination of the estimated floor and the number of passengers who get on and get out of the car in the past car allocation information with consideration for the boarding floor and the destination floor. Needless to say, the congestion degree can also be calculated to some degree from the past car allocation information illustrated in FIG. 4.

Figure 8:
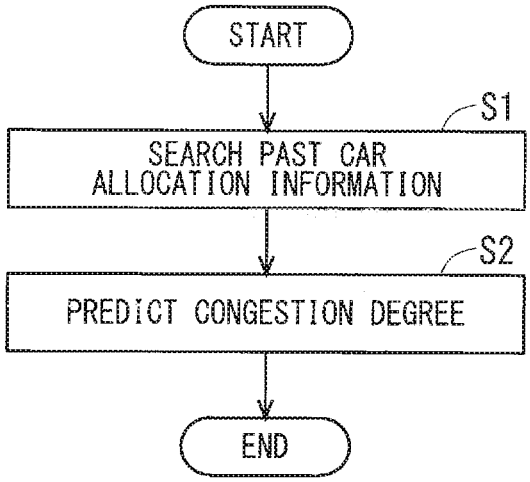
FIG. 8 A flow chart illustrating prediction processing of a congestion degree of the elevator operation managing device according to the embodiment 1.

For example, the congestion degree acquisition unit 105 may predict the congestion degree based on the boarding floor and the destination floor received by the registration receiving unit 101 and the result of the car allocation including the number of passengers stored in the car allocation information storage unit 104. Described hereinafter is an example that the congestion degree acquisition unit 105 predicts the congestion degree in the car based on a month or a season, a date and time such as a time or a day, and weather and a temperature which are subject to prediction of the congestion degree, the boarding floor and the destination floor, and the past car allocation information. FIG. 8 is a flow chart illustrating prediction processing of the congestion degree.

In Step S1, the congestion degree acquisition unit 105 acquires the date and time which is subject to prediction of the congestion degree from the registration receiving unit 101 and so on, obtains a traveling direction (upper or lower direction) from the boarding floor and the destination floor received by the registration receiving unit 101, and acquires information of all of the cars moving in the same direction as the obtained traveling direction and the car allocation of the cars from the past car allocation information. Then, the congestion degree acquisition unit 105 searches the past car allocation information similar to the acquired date and time, the car, and the car allocation from the car allocation information storage unit 104.

Predicted, for example, is a case where the acquired date and time is "February, 10:00, Monday", and the car whose congestion degree is to be obtained and the past car allocation information of the car (the past car allocation information which has not been used as described above) is "the car A, the current position: the first floor, the estimated floor: the fifth floor and the ninth floor". In this case, the congestion degree acquisition unit 105 searches the record of "February, 9:45 to 10:15, Monday" and "the car A, the current position: the first floor, the estimated floor: the fifth floor and the ninth floor" from the history of the past car allocation information stored in the car allocation information storage unit 104 (the past car allocation information which has been used as described above). If there is no such a record, the congestion degree acquisition unit 105 expands a search range to search the record of the similar date and time and the car allocation from, for example, a set of "February, 9:45 to 10:15, Monday" and "the car A, the current position: the first floor, the estimated floor: the fourth to sixth floors and the eighth to tenth floors" and a set of "February, 9:45 to 10:15, Monday" and "the car B, the current position: the first floor, the estimated floor: the fourth to sixth floors and the eighth to tenth floor".

In Step S2, the congestion degree acquisition unit 105 acquires the information regarding the number of passengers from the past car allocation information obtained in Step S1, and predicts the congestion degree based on the information regarding the obtained number of passengers.

For example, if the similar date and time and the car allocation obtained in Step S1 is "Feb. 15, 2014, 10:03, Monday", the congestion degree acquisition unit 105 acquires a combination of a floor at which the car is located and the loading weight in the car for a certain period of time after "Feb. 15, 2014, 10:03, Monday" as the information regarding the number of passengers. Then, for example, if "the first floor: X kg, the second floor: X kg, the third floor Y kg" is obtained as the combination, the congestion degree acquisition unit 105 predicts, using a maximum loading weight Z kg, "a congestion degree of the first floor: X/Z, a congestion degree of the second floor: X/Z, a congestion degree of the third floor Y/Z" as the congestion degree. If a plurality of groups of date and time and the car allocation satisfy the conditions in Step S1, it is applicable to adopt an average value of a plurality of congestion degrees predicted from each of the plurality of groups or adopt a congestion degree predicted from the most similar date and time and the most similar car allocation.

If the past car allocation information stored in the car allocation information storage unit 104 includes the number of passengers as illustrated in FIG. 5 and FIG. 6, the congestion degree acquisition unit 105 can predict the congestion degree in more detail using the number of passengers. For example, if the current date and time and so on are "February, 10:00, Monday" and "the car A, the current position: the sixth floor, the moving direction: the lower direction, the estimated floor: (the first floor: twenty passengers get out and fourteen passengers get on, the fifth floor: ten passengers get out, the ninth floor: four passengers get out)", "February, 10:00, Monday" and "the car A, the current position: the first floor, the moving direction: the upper direction, the estimated floor: (the fifth floor: twenty passengers get out, the ninth floor: eight passengers get out)" are acquired in Step S1. In this case, predicted from the contents acquired in Step S1 is that twenty-eight (=20+8) passengers get on the car A at the first floor. In contrast, the number of users getting on the car A at the first floor is fourteen at this time. Predicted accordingly is that fourteen (=28−14) passengers further get on the car A while the car A currently located at the sixth floor goes down to the first floor. The above description shows that the congestion degree acquisition unit 105 can predict that the future congestion degree of the first floor doubles the current congestion degree of the first floor.

If the registration receiving unit 101 receives the attribution of the user such as the wheelchair or the baby buggy, for example, and the car allocation information storage unit 104 also stores the attribution of the user at the same time, the attribution of the user may be used for calculating or predicting the congestion degree. For example, the congestion degree acquisition unit 105 may convert the wheelchair or the baby buggy into a value for two or three passengers, thereby predicting the congestion degree. The congestion degree acquisition unit 105 may predict not only the congestion degree but also both the congestion degree and the attribution of the user. The prediction of the congestion degree is not limited to the examples described above.

In the description described above, the congestion degree acquisition unit 105 obtains the congestion degree based on the boarding floor and the destination floor received by the registration receiving unit 101 and the past car allocation information. However, the configuration of the congestion degree acquisition unit 105 is not limited thereto, but the congestion degree may be obtained using predetermined default car allocation information instead of the past car allocation information.

<Description of in-Car Position Acquisition Unit 106>

The in-car position acquisition unit 106 obtains the in-car position of the user in the car in accordance with the predetermined behavior of getting on the car when the user gets on the car based on the layout information stored in the layout storage unit 103 and the congestion degree obtained in the congestion degree acquisition unit 105. The tendency of the user who gets on the car to be located in a position near a wall of the car rather than a position other than the position near the wall of the car is described below as the predetermined behavior of getting on the car, however, the configuration is not limited thereto.

Figure 9:
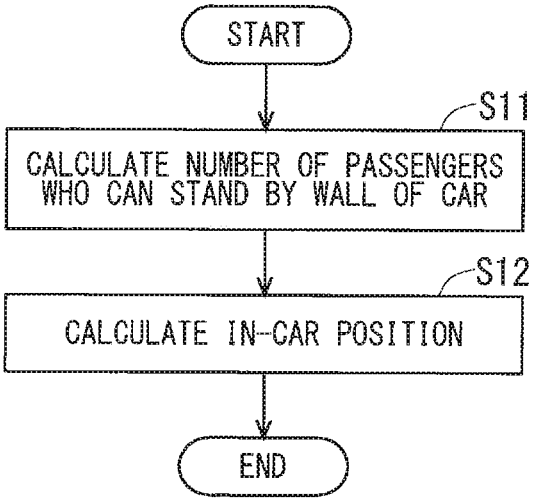
FIG. 9 A flow chart illustrating calculation processing of an in-car position in the elevator operation managing device according to the embodiment 1.
Figure 10:
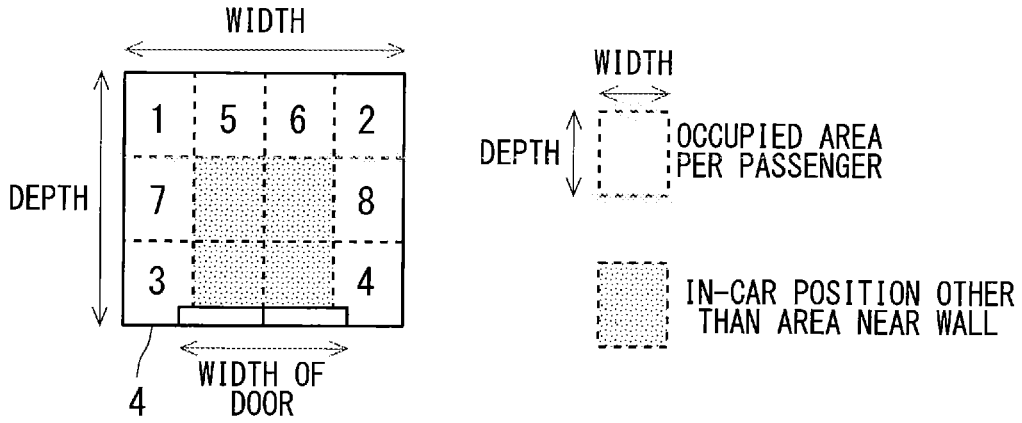
FIG. 10 A drawing for describing a calculation example of the in-car position.
Figure 11:
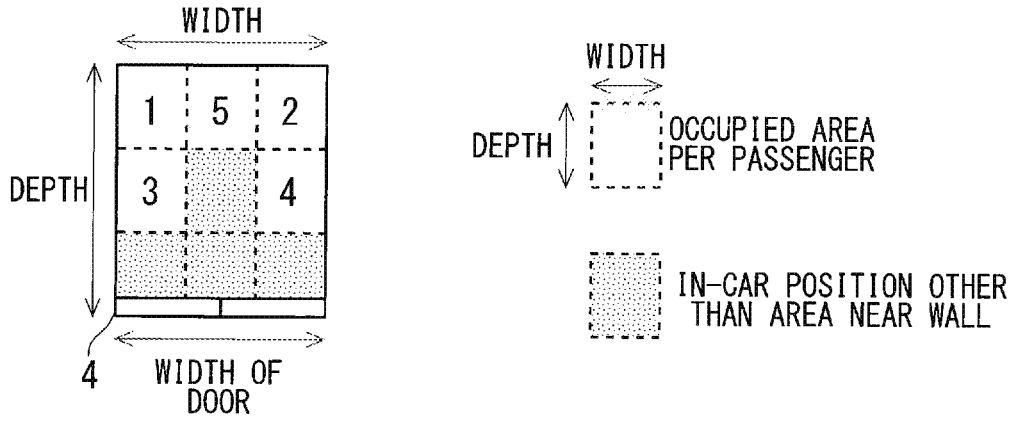
FIG. 11 A drawing illustrating a calculation example of the in-car position.

FIG. 9 is a flow chart illustrating calculation processing of the in-car position performed by the in-car position acquisition unit 106, and FIG. 10 and FIG. 11 are drawings each illustrating a calculation example of the in-car position performed by the in-car position acquisition unit 106.

Firstly, the in-car position acquisition unit 106 obtains the number of passengers who can be located near the wall of the car based on the layout information. For example, the in-car position acquisition unit 106 acquires information such as a width, a depth, and a floor space, a width of the door from the layout information stored in the layout storage unit 103, and calculates the number of passengers who can be located near the wall of the car based on the acquired information and an occupied area per passenger.

In the case of the example in FIG. 10, the in-car position acquisition unit 106 calculates the number of passengers who can be located near the wall of the empty car 4 to be eight in accordance with the layout information and the occupied area such as the width and the depth per passenger. That is to say, the in-car position acquisition unit 106 determines that the eight users can get on and be located near the wall of the empty car 4 at a maximum. Herein, the user has a higher tendency to be located near a corner in the area near the wall of the car 4 than a tendency to be located in a position other than the corner. In the case of the example in FIG. 11, the in-car position acquisition unit 106 determines that the five users can be located near the wall of the empty car 4 except the area near the door at a maximum, taking into consideration that the width of the door in relation to the whole car 4 is relatively large, and the user does not tend to be located near the door.

The occupied area per passenger, the order of getting on the car and in-car position preferred by the user, and the order of getting on the car and in-car position not preferred by the user used herein may be preset, or may be registered as the attribution information of the user from the destination registration device 1. They may also be obtained based on the past history, for example.

In Step S12, the in-car position acquisition unit 106 obtains the in-car position based on the number of passengers who can be located near the wall of the car obtained in Step S11 and the congestion degree obtained in the congestion degree acquisition unit 105.

For example, if the number of passengers is calculated as the congestion degree, the in-car position acquisition unit 106 allocates the user, the number of which does not exceed the number of passengers obtained in Step S11, to the position near the wall of the car in the users equal to the number of passengers indicated by the congestion degree, and allocates the remaining users to the position other than the position near the wall of the car. Thus, the in-car position of the users, the number of which does not exceed the number of passengers obtained in Step S1, is allocated to the position near the wall of the car, and the in-car position of the remaining users is allocated to the position other than the position near the wall of the car. According to the in-car position obtained as described above, it can be determined whether or not the user received by the registration receiving unit 101 can be located near the wall of the car.

The congestion degree other than the number of passengers is calculated as the congestion degree, the in-car position acquisition unit 106 may convert the congestion degree into the number of passengers based on the maximum number of passengers and the maximum loading weight, for example, for each car and subsequently obtain the in-car position in the manner similar to the above description.

In the examples in FIG. 10 and FIG. 11, the in-car position acquisition unit 106 obtains the in-car position in consideration of the position near the wall, however, it is also applicable that the in-car position acquisition unit 106 obtains the in-car position in consideration of the other conditions whether or not the user can stand by a handrail, sit on a chair, stand by a door or an operation board, for example. It is applicable to consider characteristics that the passenger tends to stand back of the car to see the view if the car is a see-through elevator, or the passenger tends to stand by a side, of a single swing/double swing door, on which the door opens earlier.

The attribution of the user and the congestion degree may be used to calculate the in-car position in the configuration that the wheelchair or the baby buggy, for example, is received by the registration receiving unit 101 and stored in the car allocation information storage unit 104 as the attribution of the user. For example, the in-car position acquisition unit 106 may convert the baby buggy or the wheelchair into the occupied area for two or three passengers, thereby calculating the in-car position. For example, the in-car position acquisition unit 106 may calculate the in-car position in consideration of the attribution of the user that the user prefers the wall side or the position near the entrance. Particularly, if the registration receiving unit 101 has a function capable of individual identification, the destination floor can be registered simultaneously with the reception of the attribution of the in-car position of individual (preference or tendency in the in-car position) in a case where the registration receiving unit 101 is a radio frequency identifier (RFID) tag or a smartphone, for example. In this case, a prediction accuracy of the in-car position performed by the in-car position acquisition unit 106 is improved. It is also applicable to receive the attribution of each user (preference or tendency in the in-car position) simultaneously with the registration of the destination floor even if the registration receiving unit 101 does not have the function of performing the individual identification.

The calculation of the in-car position is not limited thereto. Considered, for example, is that the in-car position acquisition unit 106 allocates the users equal to the number of passengers sequentially to the position near the corner in the area near the wall of the car, the position near the wall of the car other than the corner, and the remaining position in the car.

<Description of Car Allocation Acquisition Unit 107>

The car allocation acquisition unit 107 performs the car allocation based on the boarding floor and the destination floor received by the registration receiving unit 101, the in-car position obtained in the in-car position acquisition unit 106, and the past car allocation information. In the present embodiment 1, the car allocation acquisition unit 107 sets a limitation on an allocated destination floor which is the destination floor of the user allocable to the car based on the in-car position obtained in the in-car position acquisition unit 106. Then, the car allocation acquisition unit 107 performs the car allocation based on the destination floor received by the registration receiving unit 101 and the limited allocated destination floor. According to such a car allocation, as is clear from the description below, a switching of the passengers located back of the car and the passengers located near the door of the car can be reduced at the time of getting on and getting out of the car.

In addition, the car allocation acquisition unit 107 stores the obtained result of the car allocation as the past car allocation information in the car allocation information storage unit 104.

In the description below, the car allocation acquisition unit 107 performs the car allocation based on the boarding floor and the destination floor received by the registration receiving unit 101, the in-car position obtained in the in-car position acquisition unit 106, and the past car allocation information. However, the past car allocation information is not necessary, and the car allocation acquisition unit 107 may perform the car allocation using predetermined default car allocation information instead of the past car allocation information, for example.

Figure 12:
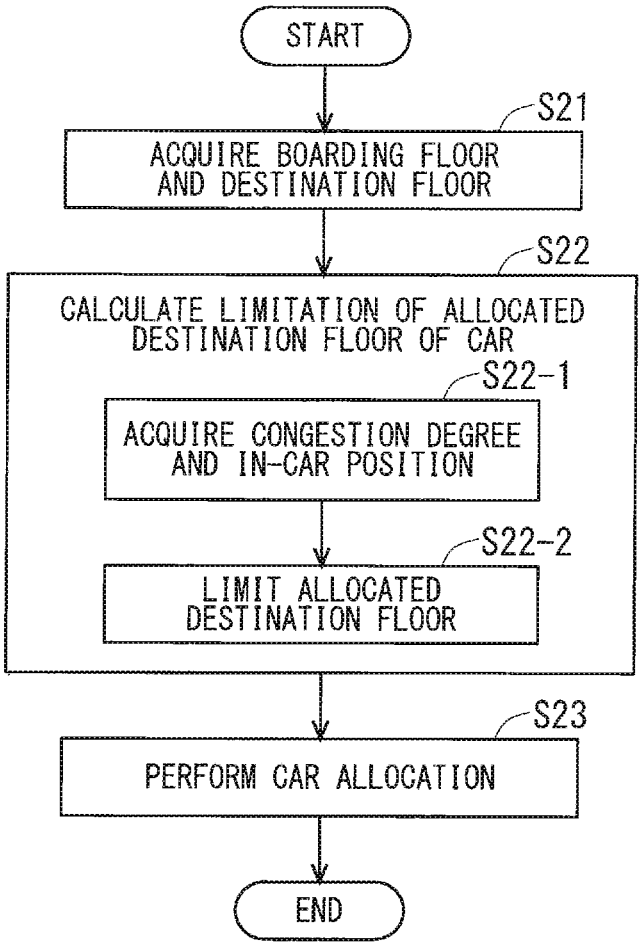
FIG. 12 A flow chart illustrating car allocation processing of the elevator operation managing device according to the embodiment 1.

FIG. 12 is a flow chart illustrating car allocation processing performed by the car allocation acquisition unit 107, and FIG. 13 to FIG. 17 are drawings each illustrating an example of the car allocation.

In Step S21, the car allocation acquisition unit 107 firstly acquires the boarding floor and the destination floor of the user from the destination registration device 1. In the present embodiment 1, the car allocation acquisition unit 107 acquires information that the user goes from an $X^{th}$ floor up to a $Y^{th}$ floor (X=1, 2, . . . , Y−1) as the destination floor of the user from the destination registration device 1. The same applies to a case where the user goes from the $Y^{th}$ floor down to the $X^{th}$ floor. The user whose boarding floor and the destination floor is acquired in Step S21 is referred to as the "focused user" hereinafter.

In Step S22, the car allocation acquisition unit 107 sets the limitation on the allocated destination floor of the car. Step S22 described above is made up of Step S22-1 and Step S22-2, and is performed on each of all the cars subject to operation management.

Figure 13:
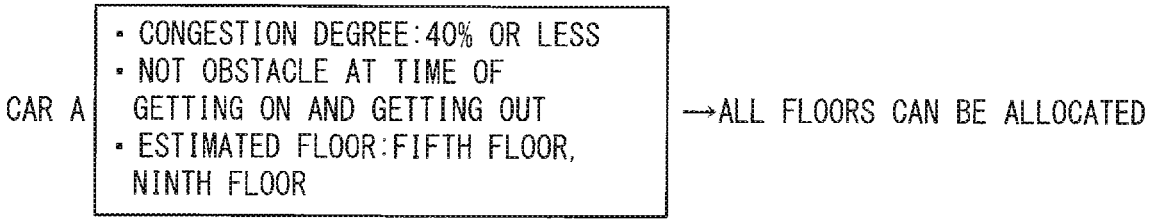
FIG. 13 A drawing for describing an example of a car allocation.
Figure 14:
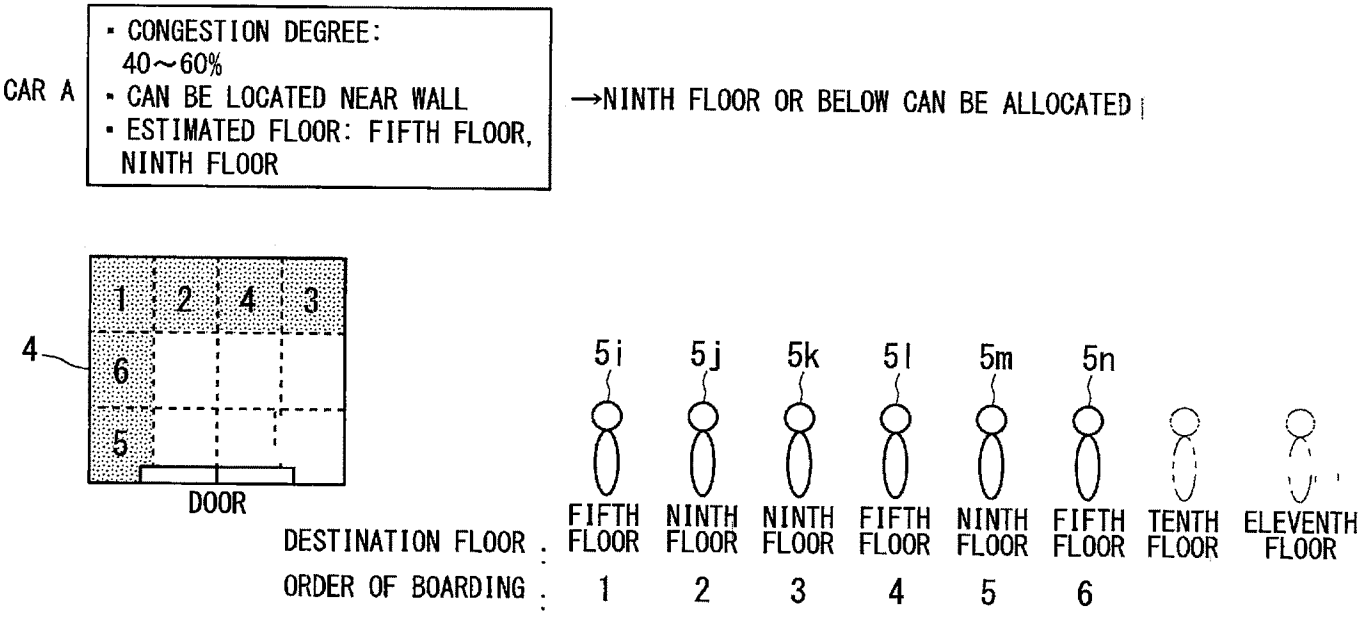
FIG. 14 A drawing for describing an example of the car allocation.
Figure 15:
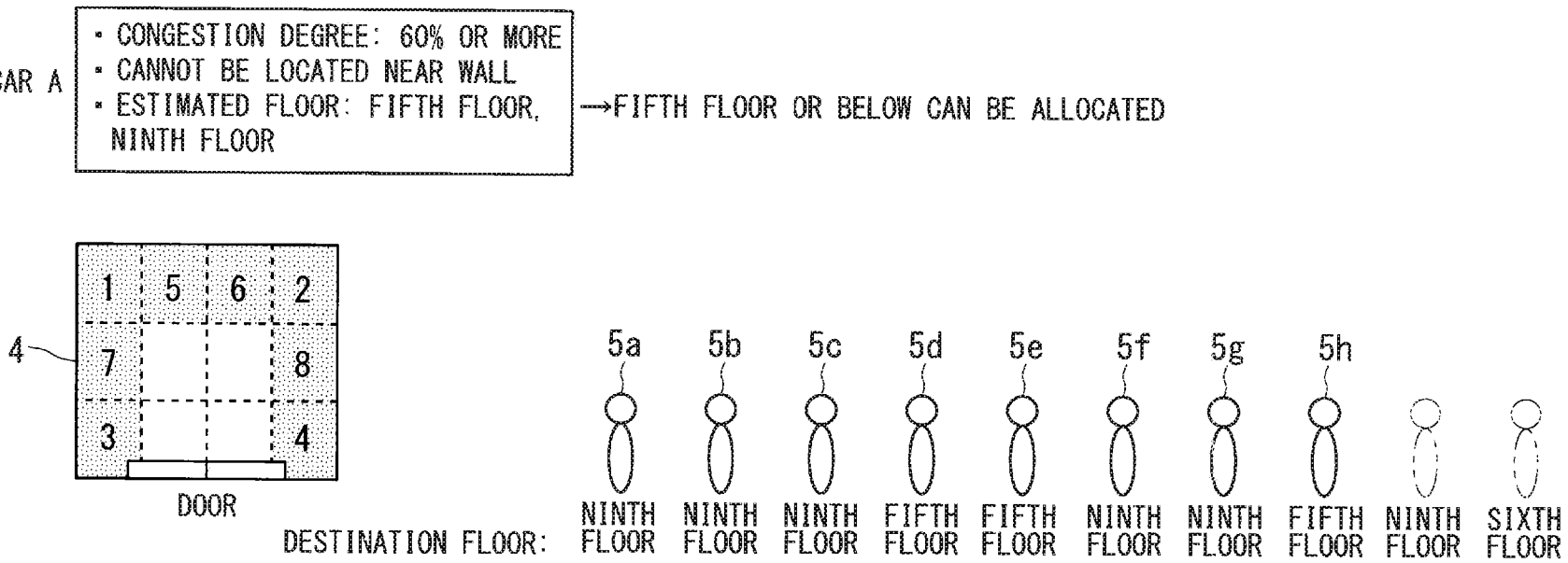
FIG. 15 A drawing for describing an example of the car allocation.

In Step S22-1, the car allocation acquisition unit 107 acquires the congestion degree when the car reaches the $X^{th}$ floor obtained in the congestion degree acquisition unit 105 and the in-car position when the car reaches the $X^{th}$ floor obtained in the in-car position acquisition unit 106. FIG. 13 to FIG. 15 illustrate the example of the congestion degree of the car and the in-car position in a case where the boarding floor of the focused user is X=1, that is to say, in a case where the focused user goes from the first floor up to the $Y^{th}$ floor, however, the processing similar to the case of X=1 is also performed in a case of X=2, 3, . . . .

Herein, the car allocation acquisition unit 107 performs the car allocation based on the congestion degree and the in-car position. However, the congestion degree can be obtained from the in-car position, thus the car allocation acquisition unit 107 may perform the car allocation based on the in-car position without using the congestion degree.

In the example described hereinafter, the car allocation acquisition unit 107 uses, in the car allocation, the congestion degree and the in-car position obtained regarding the user other than the focused user, however, the configuration of the car allocation acquisition unit 107 is not limited thereto. For example, the car allocation acquisition unit 107 may use, in the car allocation, the congestion degree and the in-car position obtained regarding the user including the focused user.

In Step S22-2, the car allocation acquisition unit 107 sets the limitation on the allocated destination floor based on the acquired congestion degree and in-car position. A rule of the limitation on the allocated destination floor is preset, and can be appropriately changed by an operator of the elevator, for example.

For example, if the congestion degree is 40% or less as illustrated in FIG. 13, the car allocation acquisition unit 107 does not set the limitation on the allocated destination floor. Thus, the focused user is allocated to the car regardless of which destination floor the focused user goes to.

For example, if the congestion degree is 40 to 60% and "the in-car position=the user can be located near the wall" is satisfied as illustrated in FIG. 14, the car allocation acquisition unit 107 sets the limitation on the allocated destination floor to only an optional floor, ranging from the current position of the car up to the farthermost floor in the estimated floor. The allocated destination floor is limited to the optional floor up to the ninth floor in the example in FIG. 14, thus the focused user whose destination floor is above the ninth floor is not allocated to the car. The reason why such a limitation is performed is that even if "the in-car position=the user can be located near the wall" is satisfied, there is a high possibility of the switching of the passengers in the car when the car reaches the fifth floor or the ninth floor by further getting the user, whose destination floor is above the ninth floor, into the car before the car reaches the fifth floor.

Assumed specifically is a case where users 5*i* to 5*n* and two users are allocated to the car A, stand in line in front of the car A in the order of registration, and get on the car A in the order of registration as illustrated in FIG. 14. Assumed in such a case is that after the user who has completed registration earlier gets on the car and is located near a back side or a wall side of the car, the user who has completed registration later gets on the car and is located near the door of the car. If the destination floor of the user who has completed registration later is above the destination floor of the user who has completed registration earlier, the possibility of the switching of the passengers located on the back side of the car and the passenger located on the door side of the car increases when the passenger located the back side of the car gets out of the car.

In contrast, the car allocation acquisition unit 107 according to the present embodiment 1 sets the limitation on the allocated destination floor as described above. Thus, the occurrence of the switching can be reduced.

For example, if the congestion degree is 60% or more and "the in-car position=the user cannot be located near the wall" is satisfied as illustrated in FIG. 15, the car allocation acquisition unit 107 sets the limitation on the allocated destination floor to only an optional floor, ranging from the current position of the car up to the nearest floor in the estimated floor. The allocated destination floor is limited to the optional floor up to the fifth floor in the example in FIG. 15, thus the focused user whose destination floor is above the fifth floor is not allocated to the car. The reason why such a limitation is performed is that, in the state where "the in-car position=the user cannot be located near the wall" is satisfied and the car is crowded to some degree, there is a high possibility of the switching of the passengers in the car when the car reaches the fifth floor by further getting the user, whose destination floor is above the fifth floor, into the car before the car reaches the fifth floor.

Assumed specifically is a case where users 5*a* to 5*n* and two users are allocated to the car A, stand in line in front of the car A in the order of registration, and get on the car A in the order of registration as illustrated in FIG. 15. Assumed in such a case is that after the user who has completed registration earlier gets on the car and is located near a back side or a wall side of the car, the user who has completed registration later gets on the car and is located near the door of the car. In the example in FIG. 15, the fifth floor and the ninth floor are already set as the estimated floor in the car A. At this time, the passenger who gets out of the car at the fifth floor is located on the back side of the car, and the passenger who gets out of the car at the floor at above the fifth floor is located on the door side of the car when the car reaches the fifth floor by further getting the user, whose destination floor is above the fifth floor, into the car even if the car stops at the ninth floor. As a result, the possibility of the occurrence of the switching of the passengers in the car increases.

In contrast, the car allocation acquisition unit 107 according to the present embodiment 1 sets the limitation on the allocated destination floor as described above. Thus, even if the car stops at the ninth floor, the focused user whose destination floor is above the fifth floor is not allocated to the car. Thus, the occurrence of the switching can be reduced. Since the congestion degree of the car of the example in FIG. 15 decreases when the car reaches the fifth floor and the passenger gets out of the car, the user is allocated to the car even when the destination floor of the user is above the fifth floor after the car reaches the fifth floor.

In Step S23, the car allocation acquisition unit 107 performs the car allocation based on the destination floor received in Step S21 and the allocated destination floor appropriately limited in Step S22, and stores the result of the car allocation, for example, in the car allocation information storage unit 104 as the past car allocation information.

Figure 16:
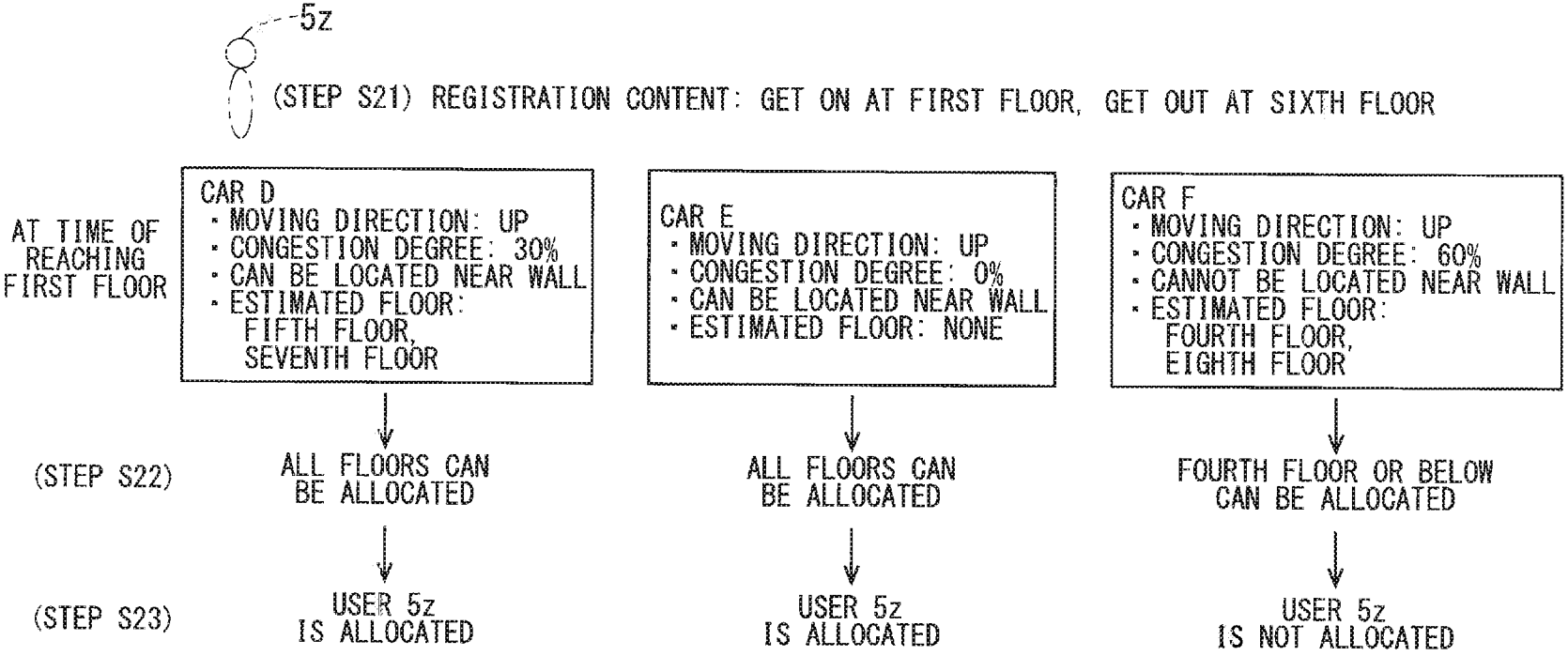
FIG. 16 A drawing for describing an example of the car allocation.
Figure 17:
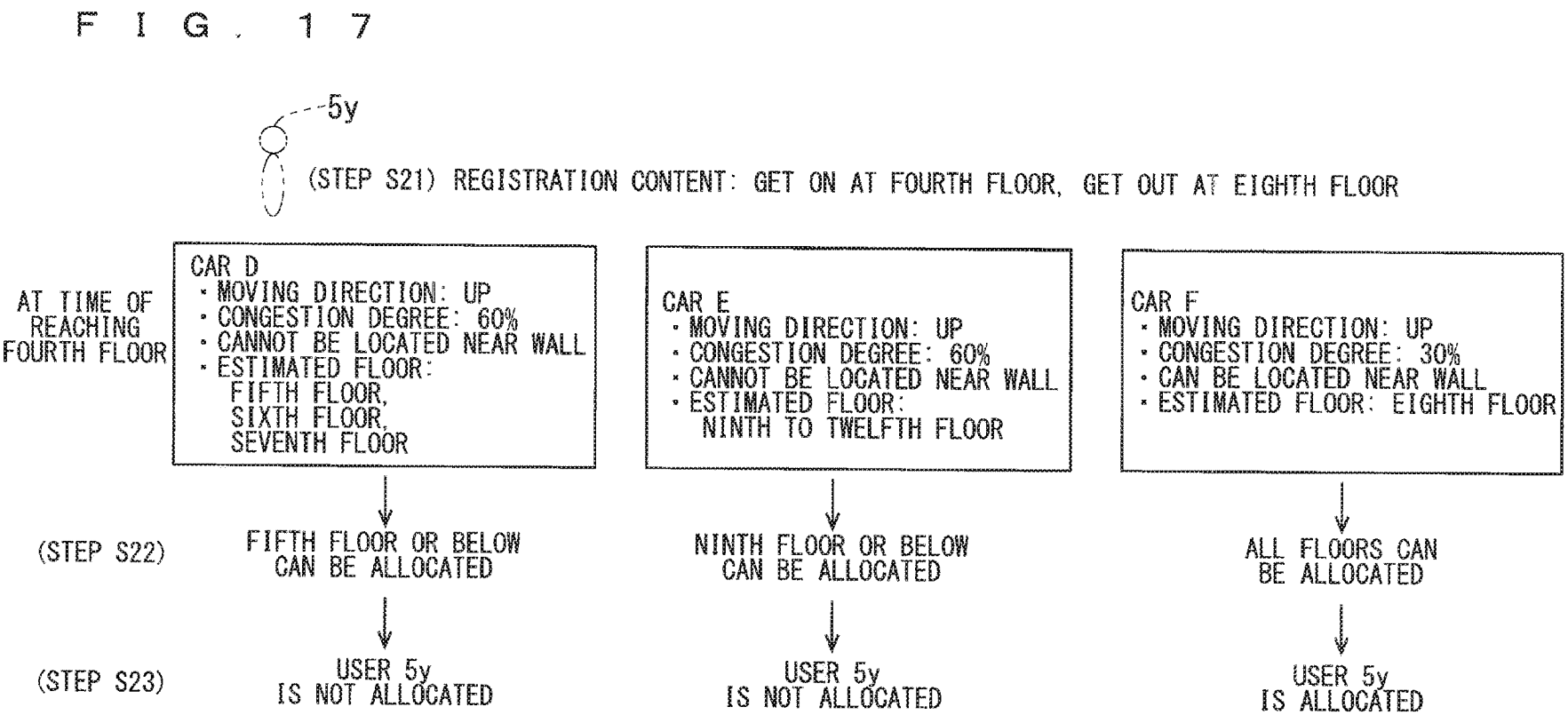
FIG. 17 A drawing for describing an example of the car allocation.
Figure 1:
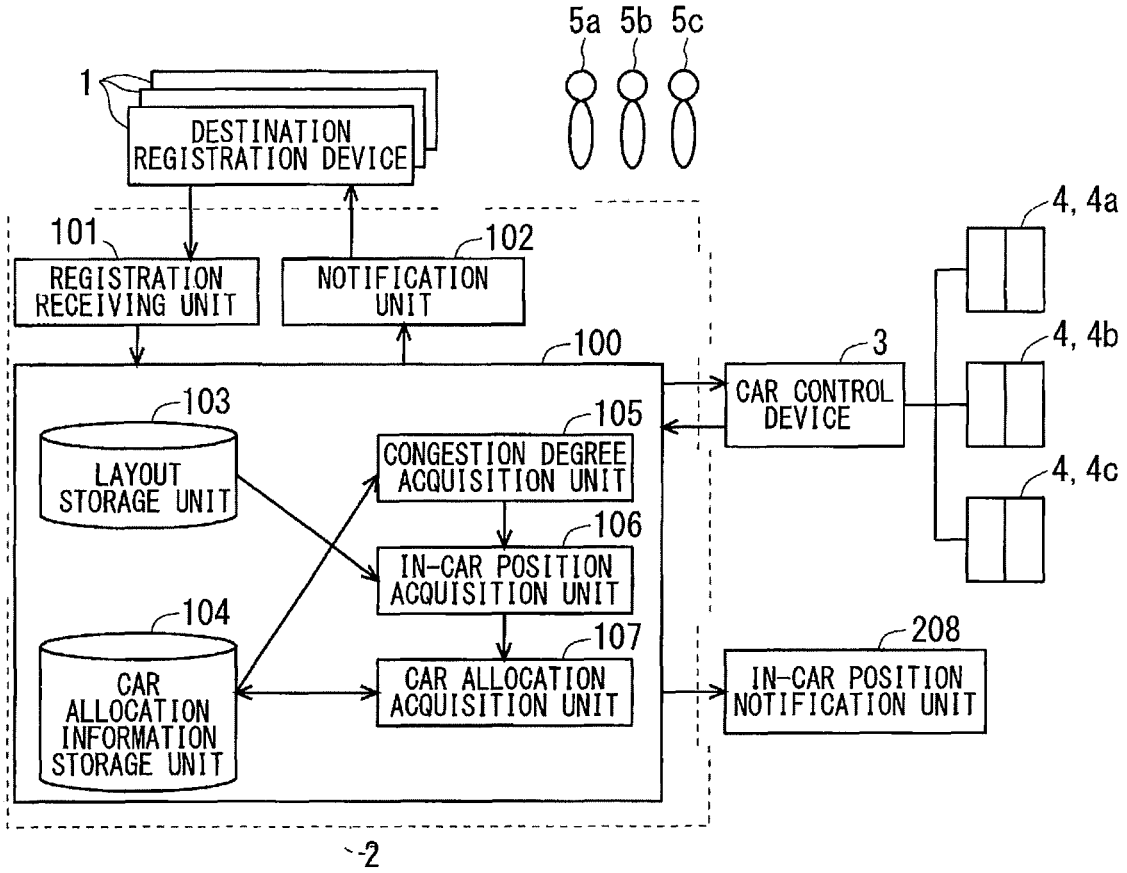
Figure 19A:
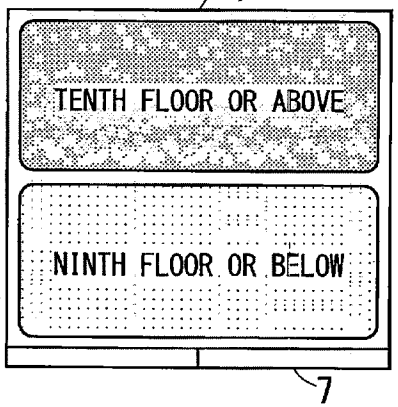
FIGS. 19A to 19E plan views illustrating a display example of the in-car position.
Figure 19B:
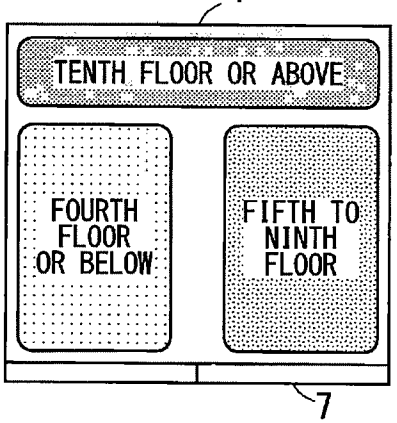
Figure 19C:
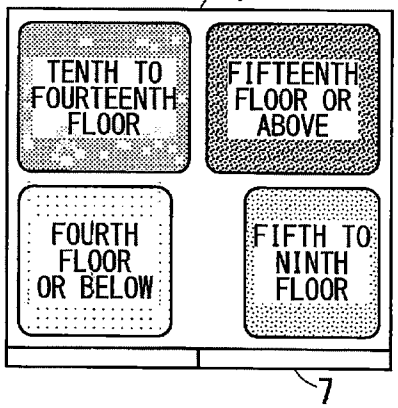
Figure 19D:
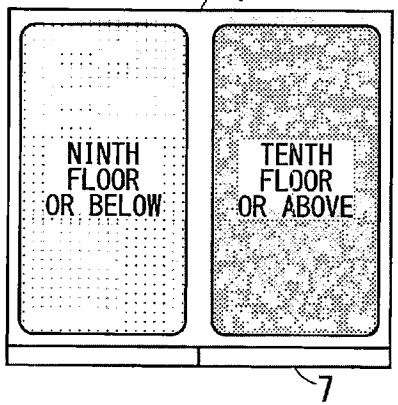
Figure 19E:
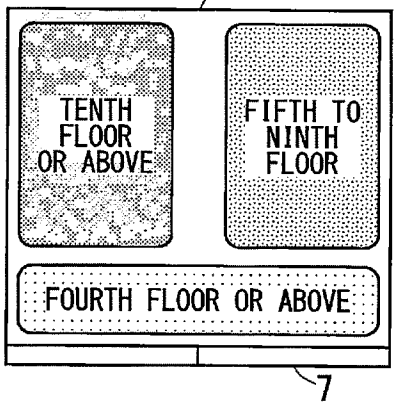

FIG. 16 and FIG. 17 illustrate examples of the car allocation performed by the car allocation acquisition unit 107 in Step S23. In the examples of FIG. 16 and FIG. 17, the operation management is performed with three cars D to F, and there are first to twelfth floors in a building.

Assumed as illustrated in FIG. 16 is a case where a user 5*z* registers to get on the car at the first floor and get out of the car at the sixth floor using the destination registration device 1 in Step S21 described above. Set at this point of time are the estimated floor of the car D=two floors (the fifth floor and the seventh floor), the estimated floor of the car E=zero floor, and the estimated floor of the car F=two floors (the fourth floor and the eighth floor).

The allocated destination floor of the cars D to F based on the in-car position, for example, indicated by the example in FIG. 16 according to Step S22 described above is limited to {the car D→no limitation, the car E→no limitation, and the car F→the fourth floor or below}.

Herein described as the example of the car allocation in Step S23 illustrated in FIG. 16 is a first example that the car allocation acquisition unit 107 allocates the estimated floor and the user to the car so that the total number of floors at which each car stops is reduced within the limitation on the allocated destination floor. In the first example, the car allocation acquisition unit 107 cannot allocate the sixth floor to the car F due to the limitation on the allocated destination floor. In the cars D and E to which the sixth floor can be allocated, the car E has the smaller number of estimated floors, thus the car allocation acquisition unit 107 allocates the user 5*z* whose destination floor is the sixth floor to the car E. If there is no car to which the user is allocated within the limitation on the allocated destination floor, the car allocation acquisition unit 107 takes measures to relax the limitation on the allocated destination floor to perform the car allocation, for example. For example, the limitation on the allocated destination floor of the car F in FIG. 16 is set to an optional floor including the fourth floor, which is the nearest floor in the destination floors which are the estimated floor, or below. If one stage of limitation on the allocated destination floor of such a car F is relaxed, the car allocation acquisition unit 107 changes the limitation on the allocated destination floor to the optional floor including the eighth floor, which is the second nearest floor, or below. If the limitation is relaxed as described above, it is possible to reduce a state where the car allocation cannot be performed and allocate the car in which the switching of the passengers in the car is minimum.

A second example different from the first example is described as a method of allocating the car in Step S23 illustrated in FIG. 16. A state where the car allocation to the user of the upper floors cannot be easily performed may occur in performing the allocation which does not depart from the limitation on the allocated destination floor if the car becomes crowded. Thus, in the second example, the car allocation acquisition unit 107 performs the allocation to leave room for the user of the upper floors in the car. Since the allocated destination floor of the car F of the example in FIG. 16 is limited to the fourth floor or below, the user of the lower floors, the first to fourth floors, is allocated to the car F. However, if the congestion degree exceeds a threshold value, for example, the user of the eighth floor is also allocated to the car F. Next, although there is no limitation on the allocated destination floor in the car D at the time of the example in FIG. 16, the fifth floor and the seventh floor are set as the estimated floor, thus estimated is that the allocated destination floor is limited to the seventh floor or below if the car becomes crowded hereafter. Thus, the user of the fifth to seventh floors is allocated to the car D. In the example in FIG. 16, the car allocation acquisition unit 107 allocates the user 5*z* whose destination floor is the sixth floor to the car D. The user of the ninth to twelfth floors takes priority to be allocated to the car E which has no estimated floor, thus the car allocation to the user of the upper floors can be performed smoothly.

Described next with reference to FIG. 17 is a case where a user 5*y* registers the fourth floor and the sixth floor as the boarding floor and the destination floor (the getting-out floor) using the destination registration device 1 after the state of FIG. 16. Set at this point of time are the estimated floor of the car D=three floors (the fifth floor, the sixth floor, and the seventh floor), the estimated floor of the car E=four floors (the ninth to twelfth floors), and the estimated floor of the car F=one floor (the eighth floor).

The allocated destination floor of the cars D to F based on the in-car position, for example, indicated by the example in FIG. 17 is limited to {the car D→the fifth floor or below, the car E→the ninth floor or below, and the car F→no limitation} according to Step S22 described above. Specifically, in the car F, the passenger gets out of the car at the fourth floor and the congestion degree thereby decreases, thus the user 5*y* can be allocated to the car F. The allocated destination floor of the car D is limited to the fifth floor or below, and the allocated destination floor of the car E is limited to the ninth floor or below.

Only the user of the fifth floor or below can be allocated to the car D as the method of allocating the car in Step S23 illustrated in FIG. 17, thus the user 5*y* whose destination floor is the sixth floor is not allocated. Although the user 5*y* can be allocated to any of the cars E and F, the car allocation acquisition unit 107 herein allocates the user 5*y* to the car F based on the number of floors as the estimated floor and the congestion degree.

The method of allocating the car and the car allocation are not limited to the above description, however, a time before the arrival of the car may be used, and a method of allocating the car and a method of calculating the car allocation for uniformly averaging the congestion degrees of the cars may be used. The method of allocating the car and the method of calculating the car allocation may be preset in the elevator operation managing device, may be switched in accordance with an operation state of the car, or may be remotely switched. In the example of the car arriving at the first floor illustrated in FIG. 16, the congestion degree of the car F in the three cars is 60% or more, the user cannot be located near the wall, and the allocated destination floor of the car F is limited to the fourth floor or below. As described above, if the allocated destination floor is limited in one or more cars in Step S22, it is also applicable to change the method of allocating the car to a method of making room in the remaining cars other than the car F, that is the car E, for example, as soon as possible. Accordingly, the remaining cars can be allocated to the user of the upper floors such as the user of the ninth floor or above, for example.

<Effect>

According to the elevator operation managing device of the present embodiment 1 described above, the car allocation is performed based on the boarding floor and the destination floor received by the registration receiving unit 101 and the in-car position obtained in the in-car position acquisition unit 106. Such a configuration enables the car allocation capable of reducing the switching between the passenger located on the back side of the car and the passenger located on the door side of the car at the time of getting on and getting out of the car. As a result, an occurrence frequency of the switching of the passengers in the car can be reduced, and a time taken to open and close the door at the time of getting on and getting out of the car and a time taken to get on and get out of the car can be reduced, thus operation efficiency of the elevator can be increased. A psychological burden of the passenger of making the other passenger move aside is reduced, thus a customer satisfaction level of the user of the elevator can be increased.

According to the present embodiment 1, the congestion degree is predicated using the past car allocation information of the car allocation information storage unit 104, thus the car allocation can be performed more appropriately.

According to the present embodiment 1, the car allocation is performed using the past car allocation information of the car allocation information storage unit 104, thus the car allocation can be performed more appropriately.

According to the present embodiment 1, the user is notified of the result of the car allocation, the user can previously recognize the result of the car allocation.

Modification Example of Embodiment 1

In the embodiment 1 described above, the method of allocating the car at the time of managing the plurality of cars is described. However, the method of allocating the car is not limited thereto, but the operation management may be performed on one car. In the car allocation of the plurality of cars described above, one of the cars is allocated to one of the users. On the other hand, the car allocation of one car indicates the allocation of one car to one of the users, and as a result, the order of the user getting on the car is determined.

A case where the elevator operation managing device 2 performs the operation management of one car is described hereinafter. Assumed is a case where the car allocation information of getting four users into the car, which is provided in a ten-story building and can have six users at a maximum, at the first floor and getting the four users out of the car at the sixth floor is stored. At this time, the car allocation acquisition unit 107 sets the limitation on the allocated destination floor in Step S22 if the fifth floor and the tenth floor are registered as the boarding floor and the getting-out floor for two users in Step S21.

Assumed, for example, is a case where the car allocation acquisition unit 107 acquires the in-car position, for example, based on a state where the four users are in the car which can have six users at a maximum at the time of reaching the fifth floor in Step S22-1. In this case, two more users can get on the car at the time of reaching the fifth floor, and the in-car position of the two users is located near the door, so that there is a high possibility of the switching of the passengers in the car. Thus, in Step S22-2, the car allocation acquisition unit 107 sets the limitation on the allocated destination floor to the sixth floor or below. The car allocation acquisition unit 107 can acquire to get a new user on the car after the car stops at the sixth floor and the passenger gets out of the car.

In Step S23, the car allocation acquisition unit 107 does not allocate the two users to the car. Thus, performed is the car allocation that the car does not stop at the fifth floor, but goes up from the first floor to stop at the sixth floor and get the passengers out of the car, then returns to and stops at the fifth floor, and then stops at the tenth floor.

Even in the case of one car, the present modification example enables the car allocation capable of reducing the switching between the passenger located on the back side of the car and the passenger located on the door side of the car.

Embodiment 2

FIG. 18 is a block diagram illustrating a configuration of an elevator operation managing device according to the embodiment 2 of the present invention. The same reference numerals as those described in the present embodiment 2 will be assigned to the same or similar constituent element in the embodiment 1, and the different constituent elements are mainly described hereinafter.

The elevator operation managing device 2 in FIG. 18 includes an in-car position notification unit 208 in addition to the elevator operation managing device 2 according to the embodiment 1 in FIG. 1. The second notification unit according to the present invention can be referred to as the in-car position notification unit 208 in FIG. 18. The in-car position notification unit 208 can notify the user of the in-car position obtained in the in-car position acquisition unit 106. That is to say, the in-car position notification unit 208 can provide the notification of an appropriate in-car position of the user in the car.

<Description of in-Car Position Notification Unit 208>

The in-car position notification unit 208 may be any of a display, projector, and light emitting diode (LED) disposed on a floor or a ceiling of the boarding area, a mobile terminal of the user, a display, projector, LED, and speaker in the car, and a design in the car, or a combination of these components, for example. The notification unit 111 of the destination registration device 1 may be used for the in-car position notification unit 208.

FIG. 19A to FIG. 19E and FIG. 20 to FIG. 24 are drawings illustrating a display example of the in-car position notified by the in-car position notification unit 208.

FIG. 19A to FIG. 19E are plan views each illustrating a display example of the in-car position where the user should be located, and FIG. 19A to FIG. 19E illustrate five examples, respectively. The car 4 and positions of a door 7 are illustrated herein, and the in-car position in the car 4 is illustrated to be separated into approximate zones for each destination floor. The user is notified of each zone with different colors and characters. In examples in FIG. 19A to FIG. 19E, all of the zones are disposed to surely come in contact with the wall of the car 4 so that user can stand in the zone of which the user is notified regardless of the destination floor of the user. A total number of zones is preferably approximately two to four, but is not limited thereto in a case of a wide elevator, for example. It is also applicable to change a size of the zone in accordance with the number of users, fix the size of the zone and change floors allocated to the zone in accordance with the number of users, or change both the size of the zone and the floor allocated to the zone in accordance with the number of users.

The in-car position illustrated by the plan views of FIG. 19A to FIG. 19E may be displayed on a mobile terminal of a user 5, may be displayed on a wall or a floor of the car 4 by being projected by a projector, may be displayed on a display embedded into the floor, or may be displayed by being projected from below the floor. A method of projecting the in-car position from the wall of the car 4 using a single focus projector may also be applicable. If the projection projecting the in-car position from two directions is used, it is suppressed that the in-car position overlaps with a person, for example, thus cannot be displayed. The in-car position may be displayed with a color or blinking of the LED embedded into the floor in a rectangular pattern.

Figure 20:
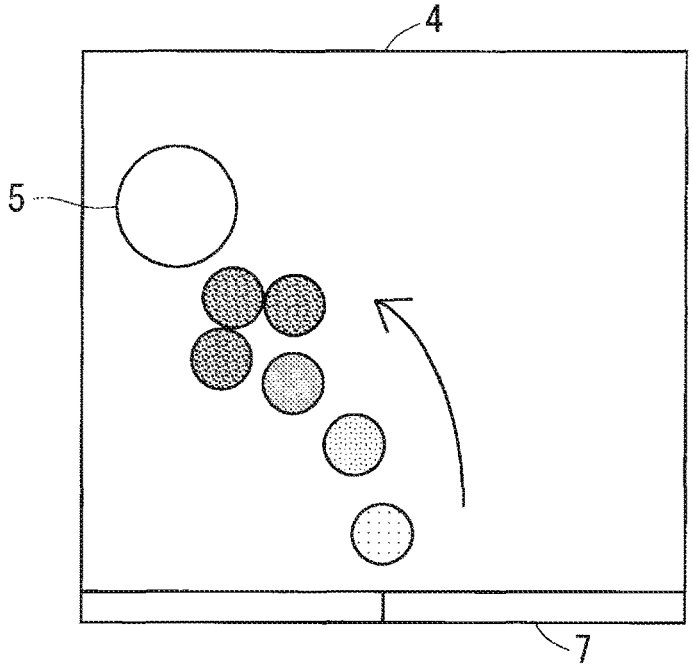
FIG. 20 A plan view illustrating a display example of the in-car position.

FIG. 20 is a plan view illustrating a display example of the in-car position where the user should be located. As illustrated in FIG. 20, when a specific user 5 gets on the car, the in-car position notification unit 208 may perform a display, using a blinking or lighting circle, arrow, or gradation, for example, in an order of route along which the user should move, to guide the in-car position where the user should be located. The in-car position notification unit 208 may display the in-car position in such a manner as a game of precisely overlapping a foot with a footprint displayed on the floor.

Figure 21:
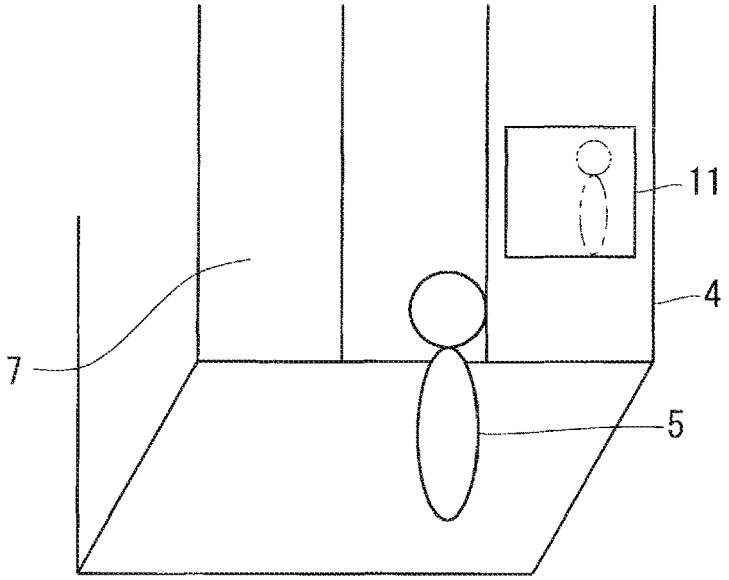
FIG. 21 A perspective view illustrating a display example of the in-car position.
Figure 22:
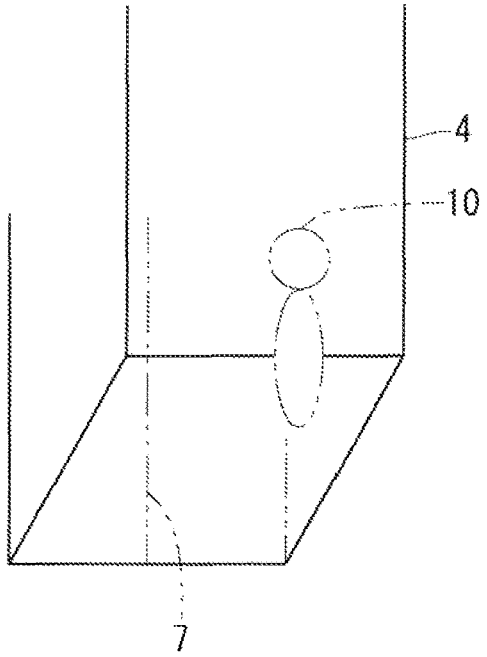
FIG. 22 A perspective view illustrating a display example of the in-car position.

FIG. 21 and FIG. 22 are perspective views each illustrating a display example of the in-car position where the user should be located. If a display 11 disposed beside the door 7, for example, displays a video of a monitoring camera as illustrated in FIG. 21, the in-car position notification unit 208 may superimpose the in-car position where the user 5 should be located on a camera video and display it. At this time, it is also applicable to display the in-car position in such a manner as a game that the user 5 superimposes the display of the display 11 on his/her in-car position while seeing the display 11, or provide the notification highlighting the in-car position of the user located in the in-car position where the switching may occur. The in-car position notification unit 208 may guide the in-car position where the user 5 should be located by providing the notification, using a mirror, to prompt the user to superimpose a reflection of the user in the mirror on a silhouette displayed on the mirror. It is also applicable to display the in-car position where the user 5 should be located by a silhouette 10 which can be displayed through augmented reality (AR) glasses which is the in-car position notification unit 208 as illustrated in FIG. 22.

Figure 23:
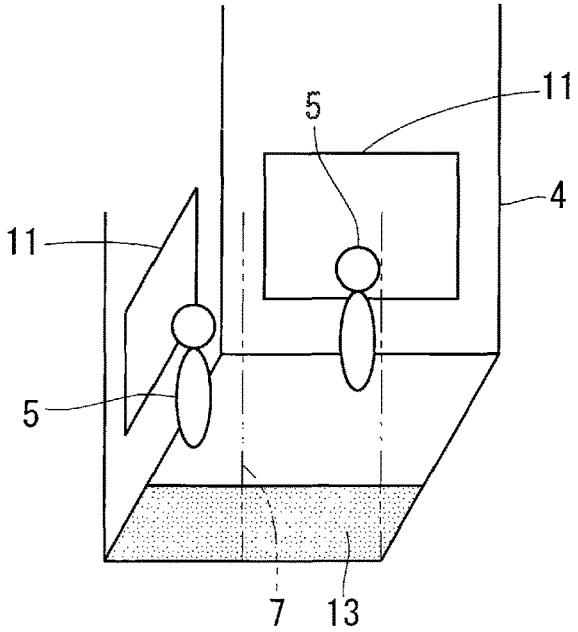
FIG. 23 A perspective view illustrating a display example of the in-car position.
Figure 24:
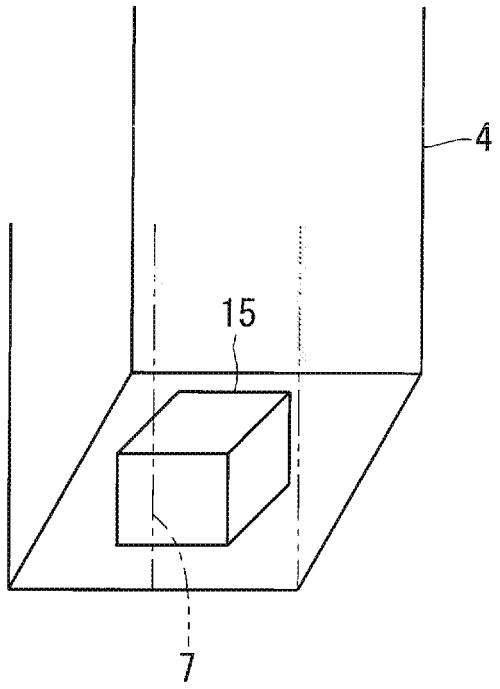
FIG. 24 A perspective view illustrating a display example of the in-car position.

FIG. 23 and FIG. 24 are perspective views each illustrating a display example of guiding the in-car position where the user should be located by performing the display attracting the user. For example, the display 11 may be disposed on the wall of the car 4 as illustrated in FIG. 23. Since a selling floor is fixed in each destination floor in a department store, for example, the display 11 close to the in-car position of the user 5 may display an advertisement or a guidance of goods in accordance with the destination floor of the user 5. The display 11 may display the guidance or the advertisement based on the attribution and destination floor of the user registered in the destination registration device 1, the in-car position obtained in the in-car position acquisition unit 106, and the car allocation performed by the car allocation acquisition unit 107.

The in-car position notification unit 208 may display a floor hole 13, a sea, or an island on a floor surface of the car 4 as illustrated in FIG. 23, or may provide a notification to prompt the user to get away from an area around the door 7, for example, to naturally guide the user 5 from the area around the door 7 to the back side. At this time, it is also applicable to provide a notification of "please get away from the door", "please move back", "please move aside for the passenger getting out of the car" to only the user located in a certain range, using a directional speaker, for example. It is also applicable to generate a strong wind around the door 7 to naturally guide the position to stand.

The in-car position notification unit 208 may display a display object 15 in the in-car position where the user should not be located as illustrated in FIG. 24, for example.

<Effect>

The elevator operation managing device according to the present embodiment 2 described above enables the car allocation capable of reducing the switching between the passengers in the manner similar to the embodiment 1. According to the present embodiment 2, the user is notified of the in-car position where the passenger, who is the user, should be located. Accordingly, the passenger can be naturally guided to the in-car position, thus the passenger can be guided to the most appropriate position in the car more smoothly and efficiently, and the switching can be further reduced at the time of getting on and getting out of the car.

Embodiment 3

Figure 25:
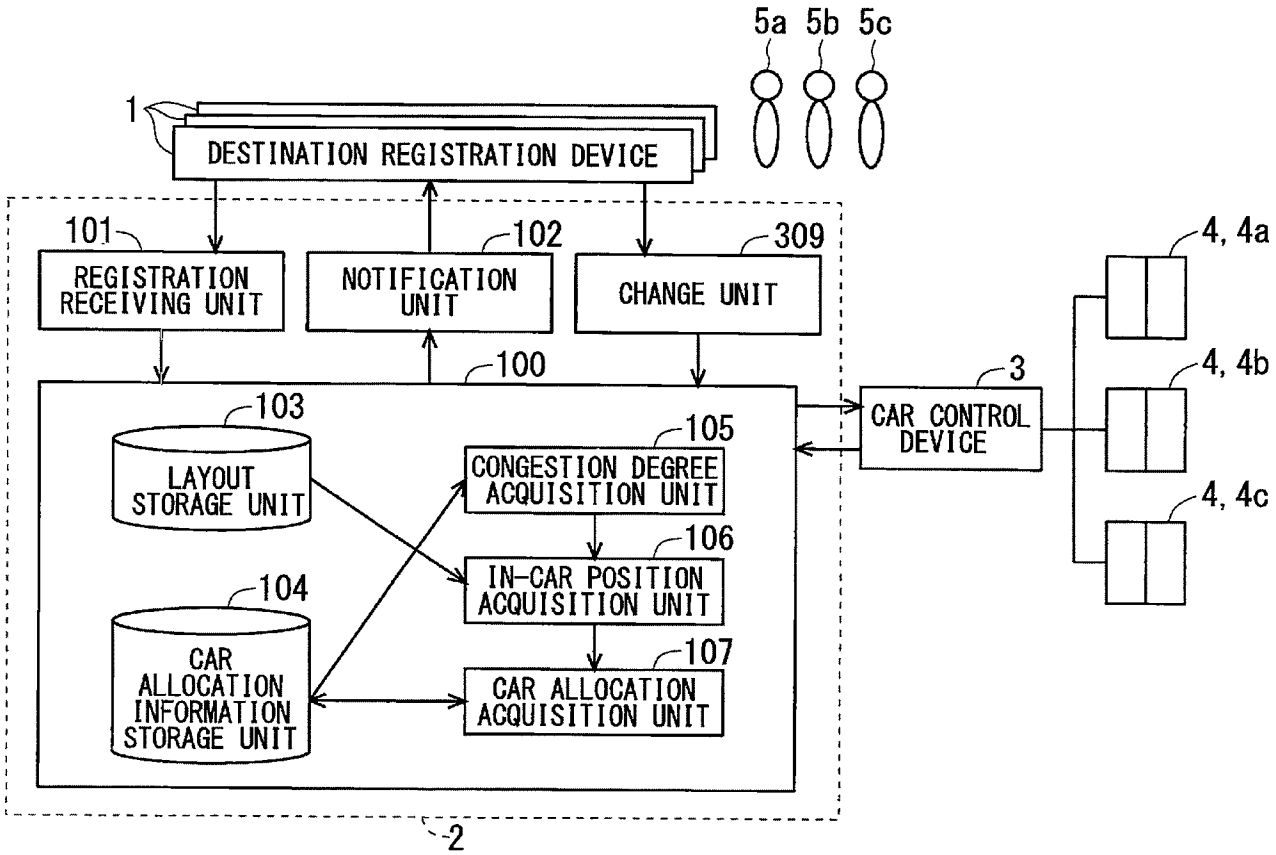
FIG. 25 A block diagram illustrating a configuration of an elevator operation managing device according to an embodiment 3.

FIG. 25 is a block diagram illustrating a configuration of an elevator operation managing device according to the embodiment 3 of the present invention. The same reference numerals as those described in the present embodiment 3 will be assigned to the same or similar constituent element in the embodiment 1, and the different constituent elements are mainly described hereinafter.

The elevator operation managing device 2 in FIG. 25 includes a change unit 309 in addition to the elevator operation managing device 2 according to the embodiment 1 in FIG. 1. The change unit 309 receives a change to the result of the car allocation notified by the notification unit 102 before the user gets on the car. Then, the car allocation acquisition unit 107 changes the car allocation notified by the notification unit 102 based on the change received by the change unit 309.

<Description of Change Unit 309>

The change unit 309 receives the change to the car allocation such as a change of the car, for example, from the destination registration device 1.

Figure 26:
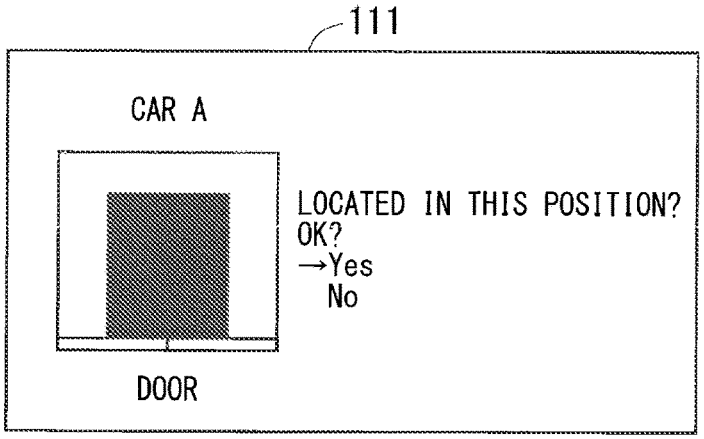
FIG. 26 A drawing illustrating a display example when a change unit receives a change.

As illustrated in FIG. 26, when the notification unit 111 of the destination registration device 1 temporarily displays the result of the car allocation and the prediction of the in-car position, the change unit 309 may receive a change request from the user via the registration unit 112 of the destination registration device 1.

Figure 27:
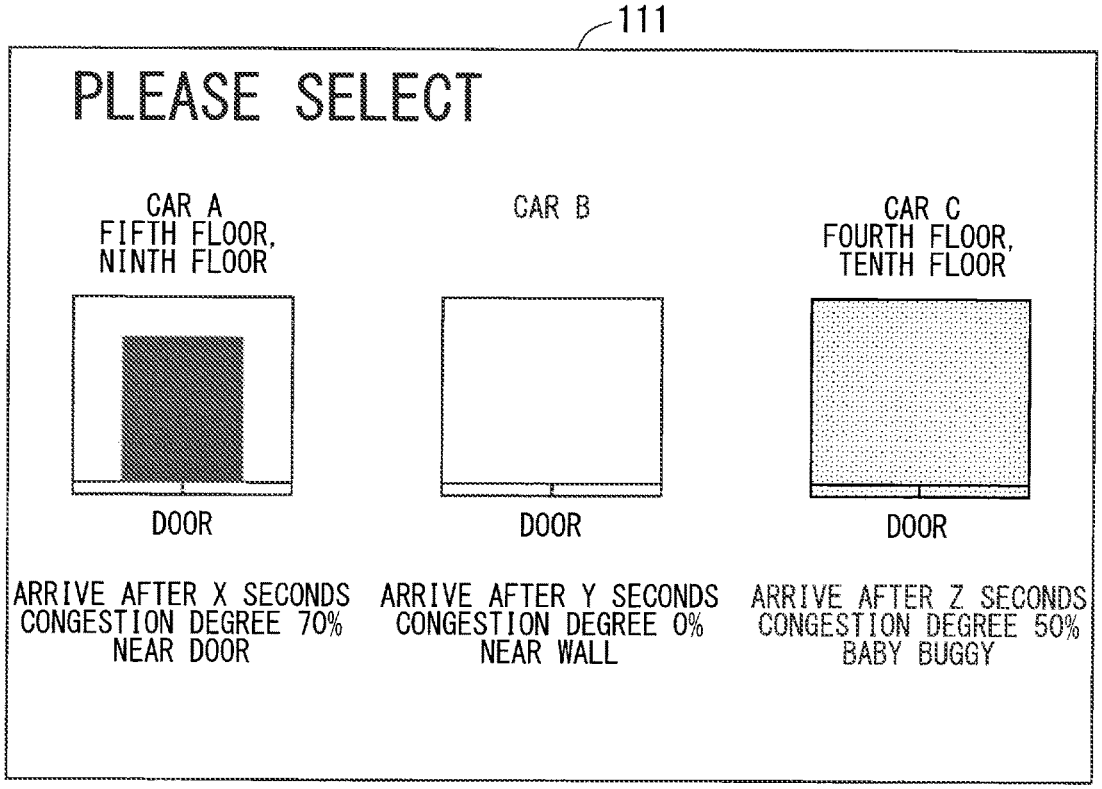
FIG. 27 A drawing illustrating a display example when the change unit receives the change.

As illustrated in FIG. 27, when the notification unit 111 of the destination registration device 1 displays the information of the estimated floor, the prediction of the in-car position, an arrival time, and the congestion degree, for example, of each car, the change unit 309 may receive the selection of the car from the user via the registration unit 112 of the destination registration device 1.

Figure 28:
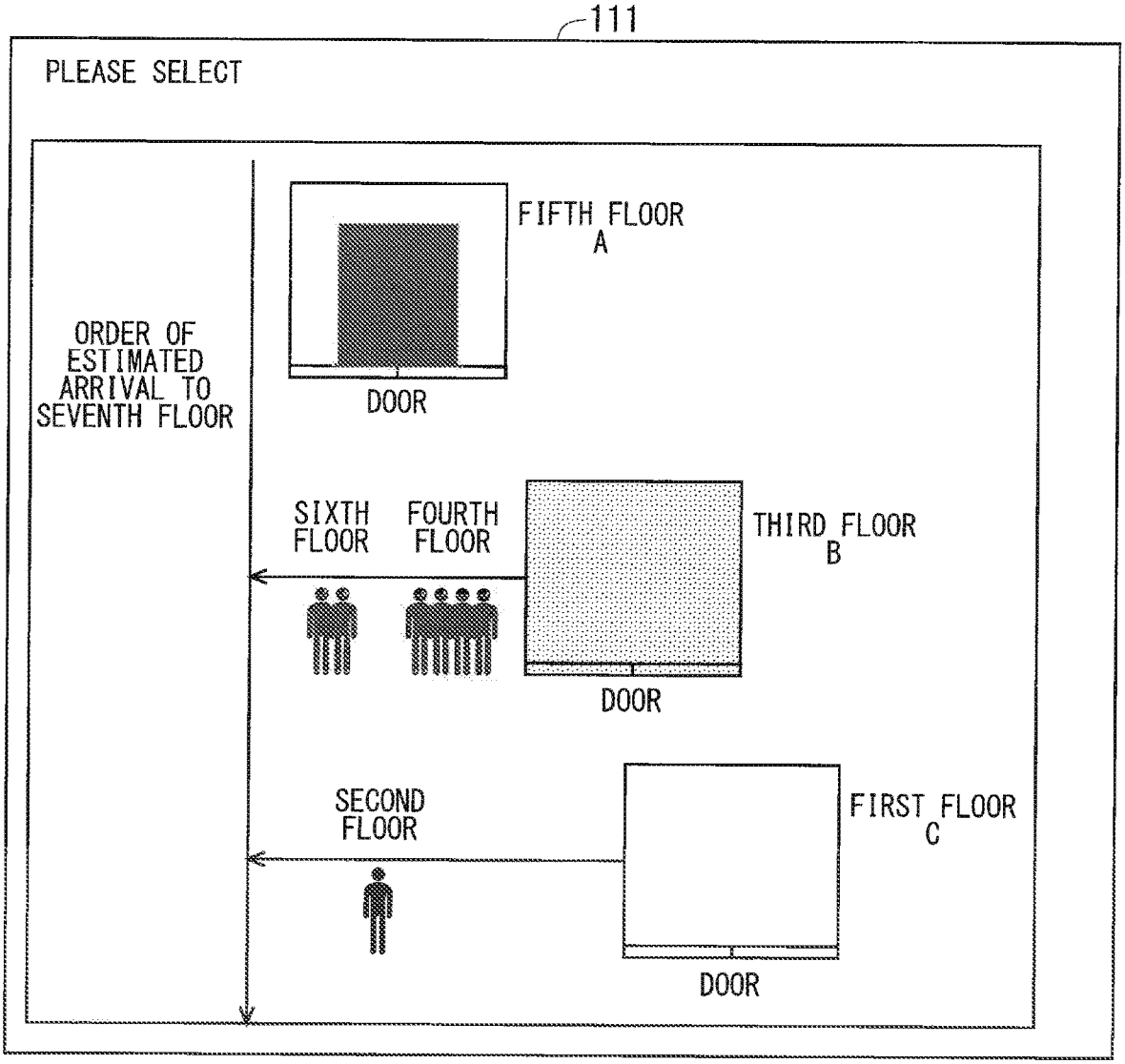
FIG. 28 A drawing illustrating a display example when the change unit receives the change.

As illustrated in FIG. 28, when the notification unit 111 of the destination registration device 1 displays the information, each car, of an order of estimated arrival, a prediction of the in-car position, the estimated floor, and an estimated number of passengers getting out of each car, the change unit 309 may receive the selection of the car from the user via the registration unit 112 of the destination registration device 1.

<Effect>

The elevator operation managing device according to the present embodiment 3 described above enables the car allocation capable of reducing the switching between the passengers in the manner similar to the embodiment 1. According to the present embodiment 3, the user can change the car allocation if the user is not satisfied with the notified car allocation.

Embodiment 4

Figure 29:
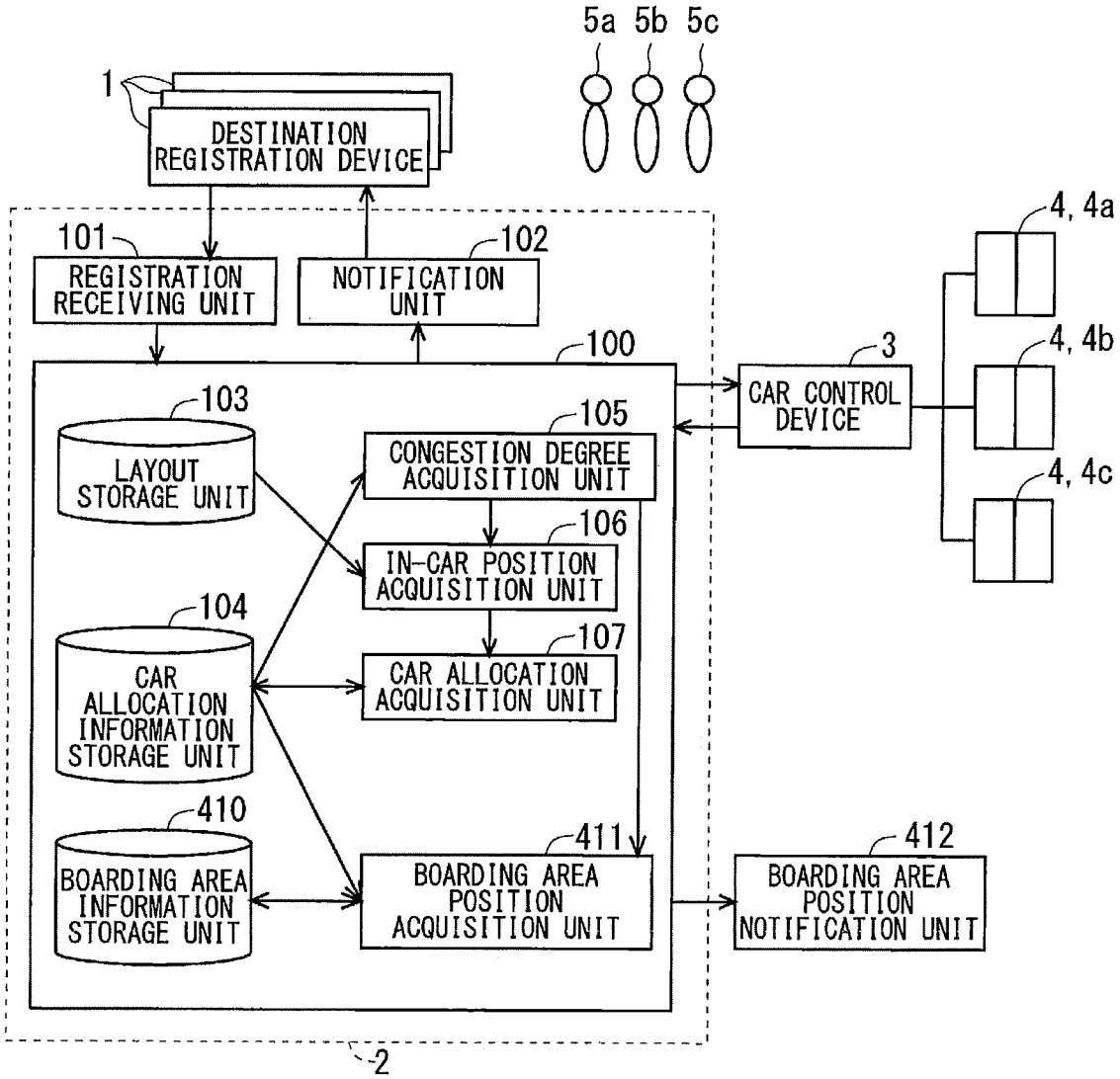
FIG. 29 A block diagram illustrating a configuration of an elevator operation managing device according to an embodiment 4.

FIG. 29 is a block diagram illustrating a configuration of an elevator operation managing device according to the embodiment 4 of the present invention. The same reference numerals as those described in the present embodiment 4 will be assigned to the same or similar constituent element in the embodiment 1, and the different constituent elements are mainly described hereinafter.

The elevator operation managing device 2 in FIG. 29 includes a boarding area information storage unit 410, a boarding area position acquisition unit 411, and a boarding area position notification unit 412 in addition to the elevator operation managing device 2 according to the embodiment 1 in FIG. 1. The third notification unit according to the present invention can be referred to as the boarding area position notification unit 412 in FIG. 29.

The boarding area information storage unit 410 stores boarding area information regarding the boarding area of the car 4. The boarding area information includes, for example, a physical size, an area, and a width of a pathway of the boarding area, an installation position of the car 4 in relation to the boarding area, and an installation position of the destination registration device 1 disposed in the boarding area. The installation position of the destination registration device 1 may be a relative position in relation to the installation position of the car 4.

The boarding area position acquisition unit 411 obtains the waiting position of the user in the boarding area in accordance with a predetermined waiting behavior based on the boarding area information stored in the boarding area information storage unit 410, the congestion degree predicted in the congestion degree acquisition unit 105, and the past car allocation information of the car allocation information storage unit 104.

The boarding area position notification unit 412 can notify the user of the waiting position obtained in the boarding area position acquisition unit 411. That is to say, the boarding area position notification unit 412 can provide the notification of the appropriate waiting position of the user in the boarding area, for example. The boarding area position notification unit 412 may also provide the notification of the car allocation information.

The car allocation acquisition unit 107 according to the present embodiment 4 performs the car allocation described above also in consideration of the waiting position obtained in the boarding area position acquisition unit 411. That is to say, the car allocation acquisition unit 107 performs the car allocation described above based on the boarding floor and the destination floor received by the registration receiving unit 101, the in-car position obtained in the in-car position acquisition unit 106, and the waiting position obtained in the boarding area position acquisition unit 411.

<Description of Boarding Area Information Storage Unit 410>

Figure 30:
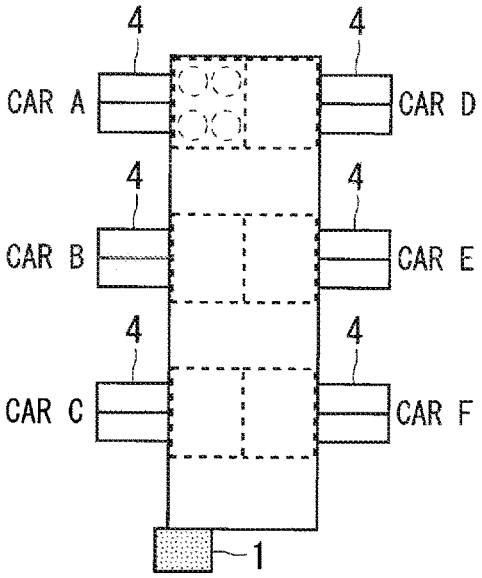
FIG. 30 A drawing illustrating an example of boarding area information.

FIG. 30 is a drawing illustrating an example of the boarding area information stored in the boarding area information storage unit 410. The boarding area information includes a physical size, an area, and a width of a pathway of the boarding area, an installation position of the car 4 in relation to the boarding area, and an installation position of the destination registration device 1 disposed in the boarding area. The boarding area information may include a total number of users 5 who can wait in front of each car 4, an area of the waiting position, an arrival time and a distance from the destination registration device to each car, or may be information indicating a plan view such as FIG. 30. Circles with a broken line in FIG. 30 indicate that the number of users 5 who can wait in front of the car 4 of the car A is four. In the description herein, the number of users 5 who can wait in front of the cars 4 of the cars B to F is also four. A numeral value of the boarding area information may be input by hand, or may also be automatically calculated from a plan view or facility information.

<Description of Boarding Area Position Acquisition Unit 411>

The boarding area position acquisition unit 411 obtains the waiting position of the user in the boarding area in accordance with a predetermined waiting behavior based on the boarding area information stored in the boarding area information storage unit 410, the congestion degree predicted in the congestion degree acquisition unit 105, and the past car allocation information of the car allocation information storage unit 104. The tendency of the user waiting for the car to be located in order from the area close to the car in the boarding area is described below as the predetermined waiting behavior, however, the configuration is not limited thereto.

In the case of the example in FIG. 14, the users 5*i* to 5*n* are allocated by the past car allocation information, thus the boarding area position acquisition unit 411 assumes that the six users wait in the waiting position in front of the car 4 of the car A.

The boarding area position acquisition unit 411 predicts how many users wait in front of the car 4 of the car A before the car 4 of the car A arrives hereafter based on the congestion degree predicted by the congestion degree acquisition unit 105. For example, if the congestion degree is the number of passengers of the car 4 of the car A, the boarding area position acquisition unit 411 predicts the number of passengers as a total number of waiting users waiting in front of the car 4 of the car A in the boarding area.

The boarding area position acquisition unit 411 predicts the waiting position of the user in front of each car in accordance with the predetermined waiting behavior based on the number of users who can wait, the predicted future number of users who will wait predicted from the congestion degree, and the current number of waiting users in front of each car predicted from the past car allocation information in the boarding area information stored in the boarding area information storage unit 410. Herein, the boarding area position acquisition unit 411 allocates the user to the area close to the door of each car in the boarding area in the order of registration. According to the waiting position obtained in such a manner, it can be determined that whether or not the area in front of the car in the boarding area is crowded and whether or not the person can pass through the boarding area near the car.

Figure 31:
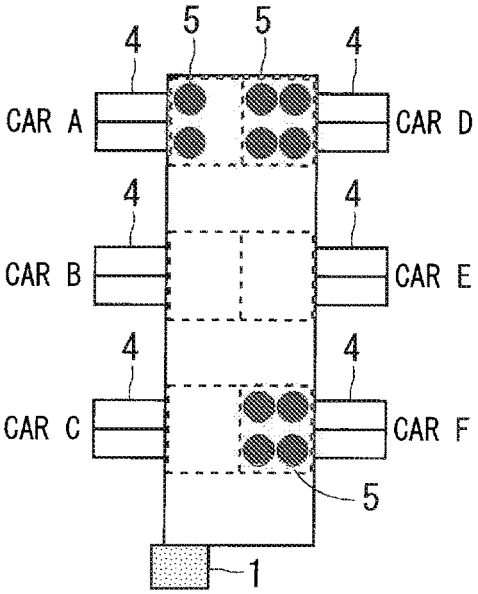
FIG. 31 A drawing for describing a calculation example of a waiting position.

For example, as illustrated in FIG. 31, if the two users 5 wait in front the car 4 of the car A, the boarding area position acquisition unit 411 obtains the information that the congestion degree is 50% and the person can pass through the boarding area as the waiting position of the user in front of the car 4 of the car A. The number of users who can wait is four herein. For example, as illustrated in FIG. 31, if no user waits in front the cars 4 of the cars B, C, and E, the boarding area position acquisition unit 411 obtains the information that the congestion degree is 0% and the person can pass through the boarding area as the waiting position of the user in front of the cars 4 of the cars B, C, and E. For example, as illustrated in FIG. 31, if the four users 5 wait in front the cars 4 of the cars D and F, the boarding area position acquisition unit 411 obtains the information that the congestion degree is 100% and the person cannot pass through the boarding area as the waiting position of the user in front of the cars 4 of the cars D and F.

If the occupied area per person waiting in front of the car is stored as the boarding area information, the boarding area position acquisition unit 411 may obtain the waiting position using the occupied area. In the meanwhile, if the occupied area is not stored, the boarding area position acquisition unit 411 may obtain an average occupied area and obtain the waiting position using the average occupied area. At this time, if the boarding area position acquisition unit 411 can acquire the attribution of the user such as the baby buggy, the boarding area position acquisition unit 411 converts the wheelchair or the baby buggy into a value for two or three passengers, thereby obtains the waiting position.

If the boarding area information includes a distance from the destination registration device 1 to each car or a time corresponding to the distance, the boarding area position acquisition unit 411 can also obtain the waiting position in consideration of a timing of when the destination is registered and a timing of when the area in front of the car is crowded.

<Description of Car Allocation Acquisition Unit 107>

The car allocation acquisition unit 107 performs the car allocation described above also in consideration of the waiting position obtained in the boarding area position acquisition unit 411.

Specifically, the car allocation acquisition unit 107 limits the allocated destination floor and performs the car allocation based on the boarding floor and the destination floor received by the registration receiving unit 101, the in-car position obtained in the in-car position acquisition unit 106, and the waiting position obtained in the boarding area position acquisition unit 411.

For example, in FIG. 31, the waiting positions of the cars D and F are already filled with the users 5. In such a case, the car allocation acquisition unit 107 performs the car allocation in consideration of whether or not the adjacent waiting position is available. For example, the car D has room in the waiting position of the car A, and the car F also has room in the waiting position of the car C, thus the car allocation acquisition unit 107 performs the car allocation in the manner similar to the car allocation described above. In the meanwhile, if the adjacent car allocation is also filled with the users, for example, the car allocation acquisition unit 107 performs the car allocation to allocate the user to the other car. Alternatively, in this case, the car allocation acquisition unit 107 does not perform the car allocation but instructs the user, via the destination registration device 1 or the boarding area position notification unit 412, for example, to wait at the other position by reason that the boarding area is crowded.

For example, the boarding area information in FIG. 30 includes, as the boarding area information of the car D, the information of using the waiting positions of the cars B and E and the waiting positions of the cars C and F as the pathway. In such a case, if the waiting positions of the cars B and E or the waiting positions of the cars C and F are filled, the user cannot reach the waiting position of the car D. Thus, the car allocation acquisition unit 107 performs the car allocation in consideration of the waiting position to prevent such a state. Specifically, the car allocation acquisition unit 107 limits the car allocation of the cars B and E to prevent the state where the waiting positions of both the cars B and E have the congestion degree of 100% and the person cannot pass through the waiting positions. Alternatively, the car allocation acquisition unit 107 does not perform the car allocation of the cars B and E but instructs the user who is allocated to the car D to wait at the other position or performs the car allocation of allocating the user to the other car which has room in the waiting position.

<Description of Boarding Area Position Notification Unit 412>

The boarding area position notification unit 412 provides the notification of the prediction of the waiting position of the user in the boarding area obtained in the boarding area position acquisition unit 411, for example, in the boarding area. The boarding area position notification unit 412 may also provide the notification of the result of the car allocation.

The boarding area position notification unit 412 may be any of a display, projector, and LED disposed on a floor or a ceiling of the boarding area, a device displaying a state of the boarding area, and a mobile terminal of the user or a combination of these components. The notification unit 111 of the destination registration device 1 may be used for the boarding area position notification unit 412.

Figure 32:
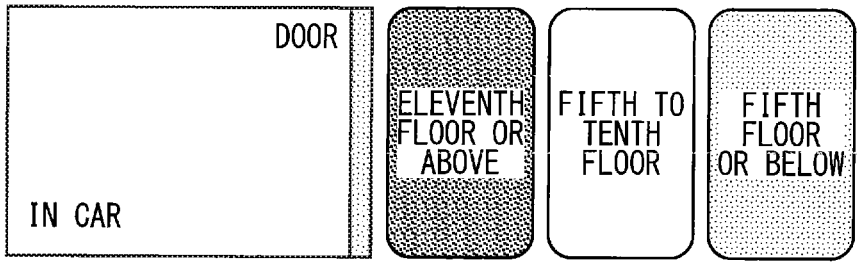
FIG. 32 A perspective view illustrating a display example of the waiting position.

FIG. 32 is a drawing illustrating an example of the waiting position provided by the boarding area position notification unit 412. In the example in FIG. 32, the boarding area position notification unit 412 displays each destination floor on the floor of the waiting position in front of each car. Thus, the notification of the waiting position with consideration of the in-car position is provided at the time of waiting, and the switching of the passengers in the car at the time of getting on and getting out of the car can be further reduced. In the example in FIG. 32, destination floors are separated into three zones, however, the configuration of the zone is not limited thereto. Positions and sizes of the zones may be changed in accordance with the number of users, a display of the floors may be changed in accordance with the number of users while fixing the positions and sizes of the zones, or the positions and sizes of the zones and the display of the floors may be changed in accordance with the number of users. It is also applicable to make the display have uniformity in such a manner that the notification of the car allocation and the waiting position have the same color with the in-car position.

Figure 33:
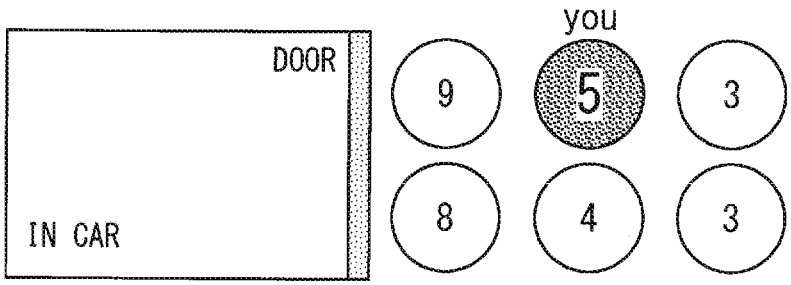
FIG. 33 A perspective view illustrating a display example of the waiting position.

FIG. 33 is a drawing illustrating another example of the waiting position provided by the boarding area position notification unit 412. In the example in FIG. 33, the boarding area position notification unit 412 displays the waiting position and the destination floor of each user on the floor of the waiting position in front of each car. The destination floor of each user is also displayed as described above, the user can clearly recognize the reason why he/she should wait at the waiting position provided by the boarding area position notification unit 412, and can easily accept the his/her waiting position.

The notification of the waiting position provided by the boarding area position notification unit 412 is not limited to the example described above.

<Effect>

The elevator operation managing device according to the present embodiment 4 described above performs the car allocation in consideration of the waiting position, thus can enable the car allocation in consideration of the congestion degree of the boarding area, for example. Accordingly, the user can be prevented from not being able to reach the targeted car due to the congestion of the boarding area.

According to the present embodiment 4, the boarding area position notification unit 412 notifies the user of the waiting position, thus the waiting position where the switching of the passengers in the car hardly occurs can be achieved at the time of waiting at the boarding area. Thus, the user can get on and get out of the car 4 more smoothly.

Modification Example of Embodiment 4

Figure 34:
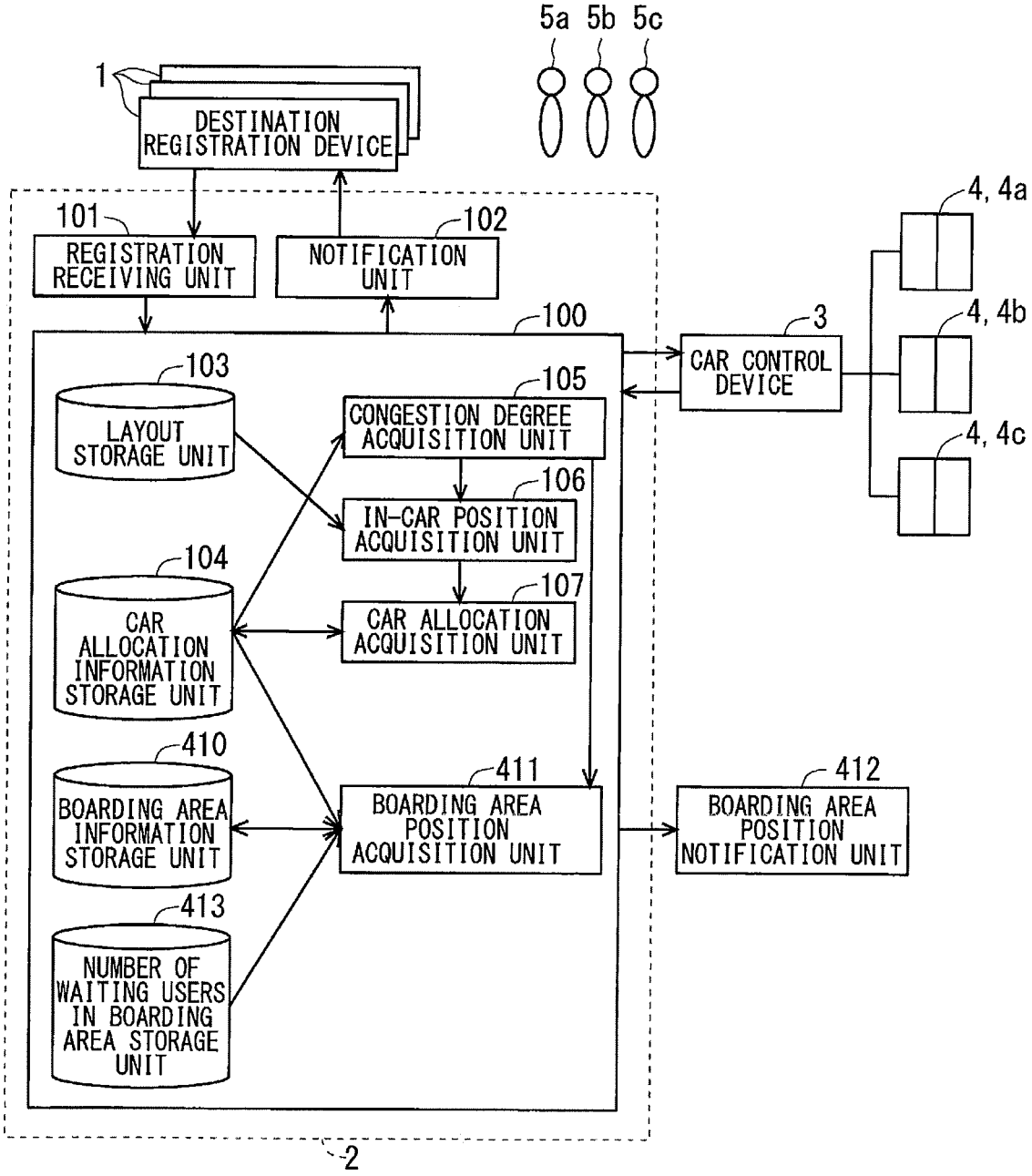
FIG. 34 A block diagram illustrating a configuration of an elevator operation managing device according to a modification example of an embodiment 4.

FIG. 34 is a block diagram illustrating a configuration of an elevator operation managing device according to the modification example of the embodiment 4. The elevator operation managing device 2 in FIG. 34 includes a number of waiting users in boarding area storage unit 413 in addition to the elevator operation managing device 2 according to the embodiment 4 in FIG. 29. The number of waiting users in boarding area storage unit 413 previously associates a car number/name, a number of a floor, a date and time, a congestion degree of the boarding area, and a total number of waiting users with each other and stores them. A past historic value, for example, is applied to a value of each item stored in the number of waiting users in boarding area storage unit 413.

The boarding area position acquisition unit 411 acquires the date and time which is subject to prediction of the congestion degree of the boarding area from the registration receiving unit 101, for example, obtains a traveling direction (upper or lower direction) from the boarding floor and the destination floor received by the registration receiving unit 101, and acquires information of all of the cars moving in the same direction as the obtained traveling direction and the car allocation of the cars from the past car allocation information. Then, the boarding area position acquisition unit 411 searches the past car allocation information similar to the acquired date and time, the car, and the car allocation from the car allocation information storage unit 104.

Predicted, for example, is a case where the acquired date and time is "February, 10:00, Monday", and the car whose congestion degree of the boarding area is to be obtained and the past car allocation information of the car (the past car allocation information which has not been used as described above) is "the car A, the current position: the first floor, the estimated floor: the fifth floor and the ninth floor". In this case, the boarding area position acquisition unit 411 searches the record of "February, 9:45 to 10:15, Monday" and "the car A, the current position: the first floor, the estimated floor: the fifth floor and the ninth floor" from the history of the past car allocation information stored in the car allocation information storage unit 104 (the past car allocation information which has been used as described above). If there is no such a record, the boarding area position acquisition unit 411 expands a search range to search the record of, for example, a set of "February, 9:45 to 10:15, Monday" and "the car A, the current position: the first floor, the estimated floor: the fourth to sixth floors and the eighth to tenth floors" and a set of "February, 9:45 to 10:15, Monday" and "the car B, the current position: the first floor, the estimated floor: the fourth to sixth floors and the eighth to tenth floor". The date and time, the car number/name, and the floor similar to the date and time which is subject to prediction of the congestion degree of the boarding area is thereby searched.

Next, the boarding area position acquisition unit 411 acquires the congestion degree and number of waiting users in the boarding area corresponding to the searched date and time, car number/name, and floor in the congestion degree and number of waiting users in the boarding area stored in the number of waiting users in boarding area storage unit 413. A method similar to the method of obtaining the congestion degree in the car performed by the congestion degree acquisition unit 105 may be used as the method of predicting the congestion degree and number of waiting users, in the boarding area, or the other method may also be used.

As described above, the boarding area position acquisition unit 411 may predict the congestion degree of the boarding area and the number of waiting users in the boarding area based on the boarding floor and the destination floor received by the registration receiving unit 101, the result of the car allocation stored in the car allocation information storage unit 104, and the information of the number of waiting users in boarding area storage unit 413.

Embodiment 5

Figure 35:
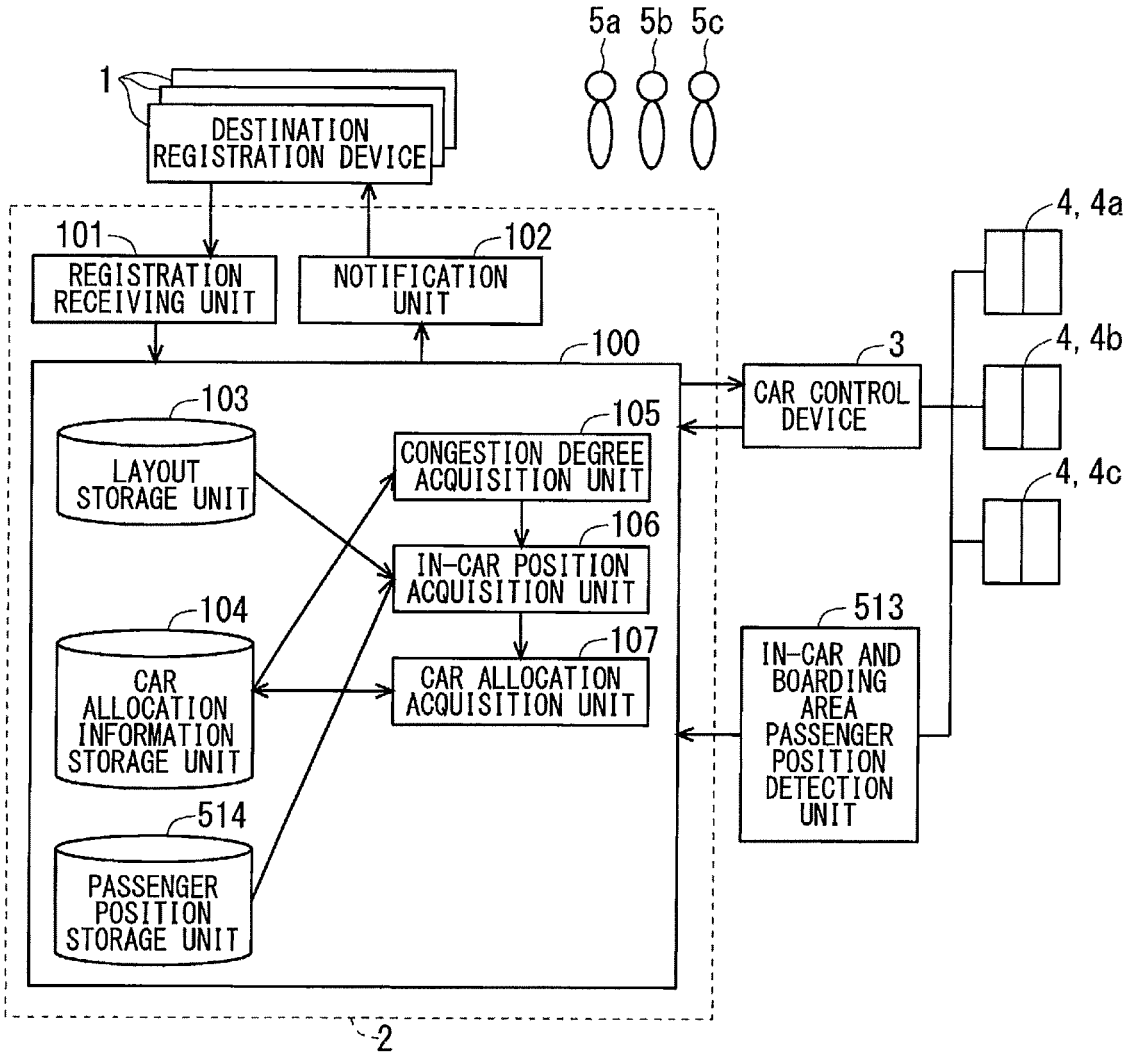
FIG. 35 A block diagram illustrating a configuration of an elevator operation managing device according to an embodiment 5.

FIG. 35 is a block diagram illustrating a configuration of an elevator operation managing device according to the embodiment 5 of the present invention. The same reference numerals as those described in the present embodiment 5 will be assigned to the same or similar constituent element in the embodiment 1, and the different constituent elements are mainly described hereinafter.

The elevator operation managing device 2 in FIG. 35 includes an in-car and boarding area passenger position detection unit 513 and a passenger position storage unit 514 in addition to the elevator operation managing device 2 according to the embodiment 1 in FIG. 1. The detection unit according to the present invention can be referred to as the in-car and boarding area passenger position detection unit 513 in FIG. 35.

The in-car and boarding area passenger position detection unit 513 detects switching information which is information regarding a presence or absence of the switching of the passengers in the car 4. In the description described below, the switching information is at least one of the in-car position of the passenger in each car and the waiting position of the passenger in the boarding area before getting on the car, however, the configuration is not limited thereto.

The passenger position storage unit 514 stores a history of the switching information detected by the in-car and boarding area passenger position detection unit 513.

The in-car position acquisition unit 106 according to the present embodiment 5 predicts the in-car position at a future time after the time of when the switching information is detected based on the congestion degree obtained in the congestion degree acquisition unit 105 and the switching information detected by the in-car and boarding area passenger position detection unit 513.

<In-Car and Boarding Area Passenger Position Detection Unit 513>

The in-car and boarding area passenger position detection unit 513 may be, for example, one of a weight sensor of the car, a monitoring camera, an RFID tag, and a smartphone application, or a combination of them. In the present embodiment 5, the in-car and boarding area passenger position detection unit 513 detects at least one of the in-car position of the passenger of each car and the waiting position of the passenger in the boarding area before getting on the car. Herein, if the in-car position or the waiting position is specified, the presence or absence of the switching of the passengers in the car 4 can be determined, thus, the in-car position or the waiting position is a concept included in the switching information described above.

The in-car and boarding area passenger position detection unit 513 may obtain the in-car position and the waiting position by performing image processing on a video taken by the monitoring camera, or may obtain the in-car position or the waiting position based on a weight measured by a weight scale disposed in the car. A coordinate for a floor surface based on a center of the door of the car, for example, may be applied to the in-car position.

The in-car and boarding area passenger position detection unit 513 may detect information other than the information described above as the switching information. For example, the in-car and boarding area passenger position detection unit 513 may detect, as the switching information, the number of passengers at the time when the switching of the passengers in the car occurs and the in-car position and destination floor of each passenger. Such a switching information is used, thus the in-car position acquisition unit 106 can roughly predict what number passenger starts standing by the door based on the past results.

Figure 36:
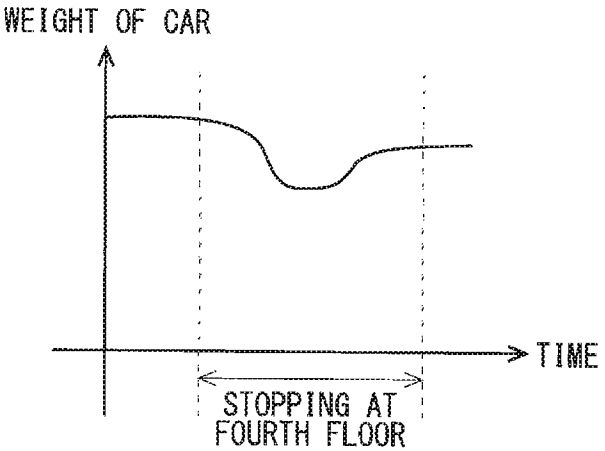
FIG. 36 A drawing illustrating an example of switching information.

The in-car and boarding area passenger position detection unit 513 may detect the switching information in corporation with the car allocation information storage unit 104. For example, as illustrated in FIG. 36, in a case where the car allocation information stored in the car allocation information storage unit 104 indicates that one passenger gets out of the car at the fourth floor, a measurement value measured by the weight scale of the car once decreases by an amount equal to three person and then increases by an amount equal to two persons while the car stops at the fourth floor. If the measurement value measured by the weight scale of the car increases even though there is no passenger newly getting on the car at the fourth floor, it can be assumed that the switching of the passengers in the car has occurred. Thus, the in-car and boarding area passenger position detection unit 513 may detect an amount of weight in the car calculated from the weight measured by the weight scale of the car to detect the switching information based on the amount of weight and the car allocation information stored in the car allocation information storage unit 104.

<Passenger Position Storage Unit 514>

The passenger position storage unit 514 stores the history of the switching information detected by the in-car and boarding area passenger position detection unit 513. In the present embodiment 5, the passenger position storage unit 514 stores the number of passengers, the congestion degree, and the car allocation, for example, together. That is to say, the passenger position storage unit 514 stores the congestion degree and the switching information together. At this time, the passenger position storage unit 514 may also store a date and time, a car number, and a floor, for example, together.

<In-Car Position Acquisition Unit 106>

The in-car position acquisition unit 106 predicts the in-car position at a future time after the time of when the switching information is detected based on the congestion degree obtained in the congestion degree acquisition unit 105 and the switching information detected by the in-car and boarding area passenger position detection unit 513 and stored in the passenger position storage unit 514. The in-car position predicted by the in-car position acquisition unit 106 is used for the car allocation performed by the car allocation acquisition unit 107 in the manner similar to the embodiment 1.

<Effect>

The elevator operation managing device according to the present embodiment 5 described above associates the switching information of whether or not the switching of the passengers in the car has occurred in the past with the congestion degree at that time to predict the in-car position. Thus, the limitation on the floors allocated to the car performed by the car allocation acquisition unit 107 can be calculated more appropriately, and the switching of the passengers in the car at the time of getting on and getting out of the car can be reduced appropriately. Since the passenger position storage unit 514 stores the history of the switching information detected by the in-car and boarding area passenger position detection unit 513, the in-car position acquisition unit 106 can predict the in-car position of the passenger more accurately. For example, it is possible to obtain a person who is often located near the door or a person who tend to be often located at the corner on the back side of the car, for example, from the history of the switching information of the passenger position storage unit 514.

Embodiment 6

Figure 37:
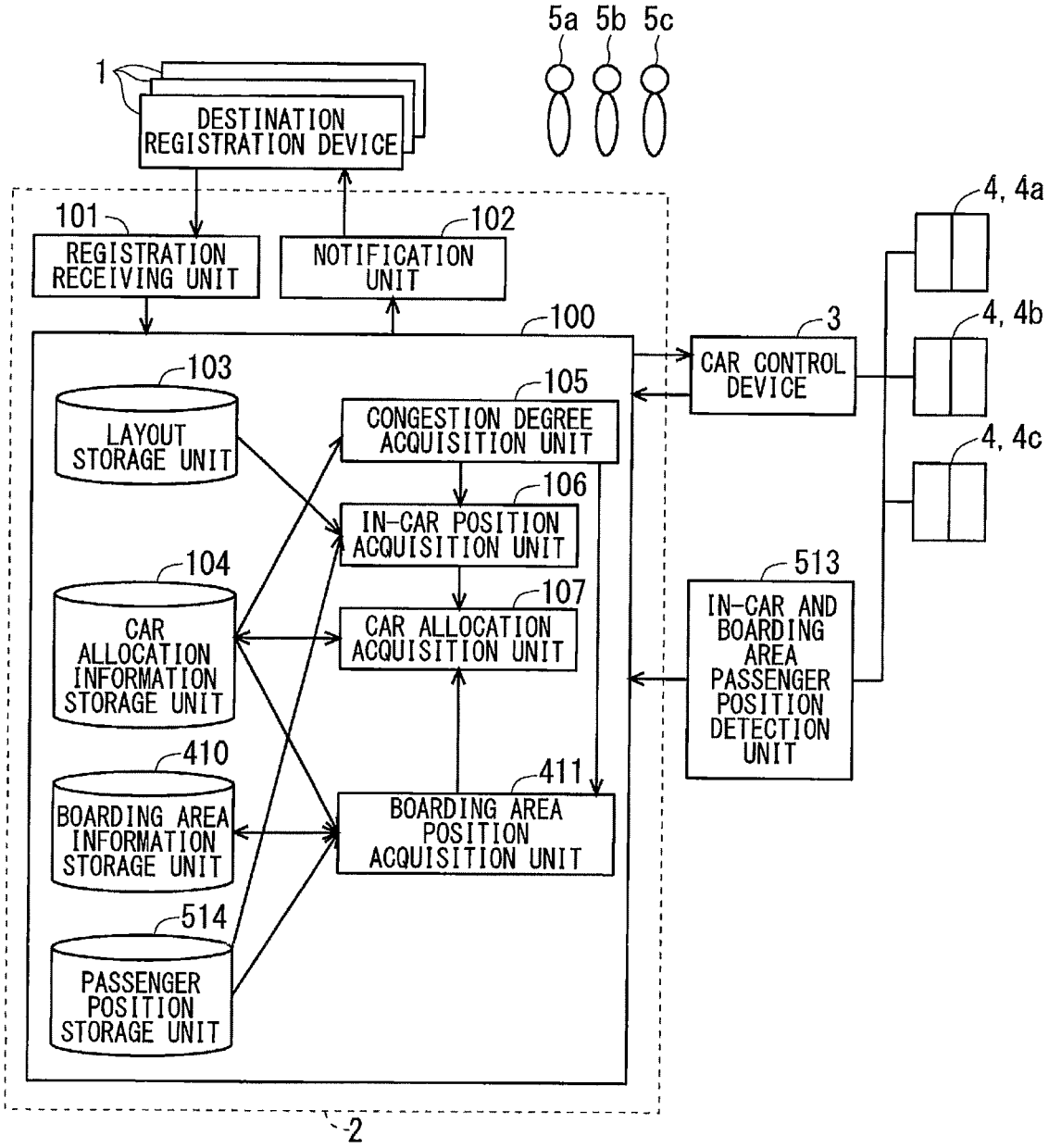
FIG. 37 A block diagram illustrating a configuration of an elevator operation managing device according to an embodiment 6.

FIG. 37 is a block diagram illustrating a configuration of an elevator operation managing device according to the embodiment 6 of the present invention. The same reference numerals as those described in the present embodiment 6 will be assigned to the same or similar constituent element in the embodiment 4 or 5, and the different constituent elements are mainly described hereinafter.

The elevator operation managing device 2 in FIG. 37 includes the boarding area information storage unit 410 and the boarding area position acquisition unit 411 in FIG. 29 described in the embodiment 4 and the in-car and boarding area passenger position detection unit 513 and the passenger position storage unit 514 in FIG. 35 described in the embodiment 5.

The boarding area position acquisition unit 411 according to the present embodiment 6 predicts the waiting position of the user in the boarding area also in consideration of the switching information detected by the in-car and boarding area passenger position detection unit 513 and stored in the passenger position storage unit 514. That is to say, the boarding area position acquisition unit 411 predicts the waiting position at a future time after the time of when the switching information is detected based on the boarding area information stored in the boarding area information storage unit 410, the congestion degree predicted by the congestion degree acquisition unit 105, the past car allocation information of the car allocation information storage unit 104, and the switching information detected by the in-car and boarding area passenger position detection unit 513. The prediction of the waiting position performed by the boarding area position acquisition unit 411 is similar to the prediction of the in-car position performed by the in-car position acquisition unit 106 described in the embodiment 5. The waiting position predicted by the boarding area position acquisition unit 411 is used for the car allocation performed by the car allocation acquisition unit 107 in the manner similar to the embodiment 4.

<Effect>

The elevator operation managing device according to the present embodiment 6 described above associates the switching information of whether or not the switching of the passengers in the car has occurred in the past with the congestion degree at that time to predict the waiting position. Thus, the waiting position can be predicted more appropriately. As a result, the limitation on the floors allocated to the car performed by the car allocation acquisition unit 107 can be calculated more appropriately, and the switching of the passengers in the car at the time of getting on and getting out of the car can be reduced appropriately.

According to the present invention, each embodiment and each modification example can be arbitrarily combined, or each embodiment and each modification example can be appropriately varied or omitted within the scope of the invention.

The present invention has been shown and described in detail, the foregoing description is in all aspects illustrative and not restrictive. It is therefore understood that numerous modifications and variations can be devised without departing from the scope of the invention.

EXPLANATION OF REFERENCE SIGNS

2 elevator operation managing device, 4, 4*a*, 4*b*, 4*c* car, 101 registration receiving unit, 102 notification unit, 103 layout storage unit, 104 car allocation information storage unit, 105 congestion degree acquisition unit, 106 in-car position acquisition unit, 107 car allocation acquisition unit, 208 in-car position notification unit, 309 change unit, 410 boarding area information storage unit, 411 boarding area position acquisition unit, 412 boarding area position notification unit, 513 in-car and boarding area passenger position detection unit.

The invention claimed is:

1. An elevator operation managing device managing an operation of a car of an elevator, comprising:

a processor to execute a program; and a memory to store the program which, when executed by the processor, performs processes of:

a receiving process that receives a boarding floor and a destination floor of a user of the elevator before the user gets on the car;

a congestion degree acquisition process that obtains a predicted congestion degree in the car for when the user gets on the car based on the boarding floor and the destination floor received by the receiving process;

an in-car position acquisition process that obtains a predicted in-car position of the user for when the user gets on the car based on the predicted congestion degree obtained in the congestion degree acquisition process; and a car allocation acquisition process that performs a car allocation for allocating the user to the car based on the boarding floor and the destination floor received by the receiving process and the predicted in-car position obtained in the in-car position acquisition process.

2. The elevator operation managing device according to claim 1, wherein the in-car position acquisition process obtains the predicted in-car position of the user in the car in accordance with a predetermined behavior of getting on the car for when the user gets on the car based on layout information regarding the car and the predicted congestion degree obtained in the congestion degree acquisition process.

3. The elevator operation managing device according to claim 1, wherein the car allocation acquisition process sets a limitation on an allocated destination floor which is a destination floor of a user allocable to the car based on the in-car position obtained in the in-car position acquisition process, and performs the car allocation based on the destination floor received by the receiving process and the allocated destination floor which is limited.

4. The elevator operation managing device according to claim 1, wherein the program when executed by the processor, further performs:

a car allocation information storage process that stores a result of the car allocation performed by the car allocation acquisition process as past car allocation information, wherein the congestion degree acquisition process predicts the predicted congestion degree based on the boarding floor and the destination floor received by the receiving process and the past car allocation information.

5. The elevator operation managing device according to claim 1, wherein the program when executed by the processor, further performs:

a car allocation information storage process that stores a result of the car allocation performed by the car allocation acquisition process as past car allocation information, wherein the car allocation acquisition process performs the car allocation based on the boarding floor and the destination floor received by the receiving process, the predicted in-car position obtained in the in-car position acquisition process, and the past car allocation information.

6. The elevator operation managing device according to claim 2, wherein the program when executed by the processor, further performs:

a layout storage process that stores the layout information.

7. The elevator operation managing device according to claim 1, wherein the program when executed by the processor, further performs:

a car allocation notification process capable of notifying the user of the result of the car allocation performed by the car allocation acquisition process.

8. The elevator operation managing device according to claim 1, wherein the program when executed by the processor, further performs:

an in-car position notification process capable of notifying the user of the in-car position obtained in the in-car position acquisition process.

9. An elevator operation managing method managing an operation of a car of an elevator, comprising:

receiving a boarding floor and a destination floor of a user of the elevator before the user gets on the car;

obtaining a predicted congestion degree in the car for when the user gets on the car based on the received boarding floor and the destination floor;

obtaining a predicted in-car position of the user for when the user gets on the car based on the obtained predicted congestion degree; and performing a car allocation for allocating the user to the car based on the received boarding floor and the destination floor and the obtained predicted in-car position.

10. The elevator operation managing device according to claim 1, wherein the predicted in-car position includes one of a position near the wall of the car and a position away from the wall of the car.

11. The elevator operation managing device according to claim 10, wherein the in-car position acquisition process is configured to determine a number of users that may be arranged in the position near the wall of the car based on a dimension of the car and an occupied area per passenger.

12. The elevator operation managing device according to claim 11, wherein the occupied area per passenger is obtained based on attribution information provided by the user or past history.

13. The elevator operation managing device according to claim 12, wherein the attribution information includes an indication of whether the user has a wheelchair or a baby buggy.

14. The elevator operation managing device according to claim 1, wherein the predicted in-car position further includes one of a position near a handrail in the car, a position in a chair in the car, a position near an operation panel in the car, a position near a door in the car, and a position with a view out of a window in the car.

* * * * *